US006171159B1

(12) United States Patent
Shen et al.

(10) Patent No.: US 6,171,159 B1
(45) Date of Patent: Jan. 9, 2001

(54) STEERING AND BACKING SYSTEMS FOR WATERJET CRAFT WITH UNDERWATER DISCHARGE

(75) Inventors: Young T. Shen, Potomac, MD (US); Frank B. Peterson, McLean, VA (US); Scott Gowing, North Potomac, MD (US)

(73) Assignee: The United States of America as represented by the Secretary of the Navy, Washington, DC (US)

( * ) Notice: Under 35 U.S.C. 154(b), the term of this patent shall be extended for 0 days.

(21) Appl. No.: 09/391,604

(22) Filed: Sep. 7, 1999

(51) Int. Cl.[7] ..... B63H 11/117

(52) U.S. Cl. ..... 440/43; 440/38; 60/222; 114/163

(58) Field of Search ..... 440/38–41, 43, 440/47; 114/163, 151; 60/221, 222

(56) References Cited

U.S. PATENT DOCUMENTS

| | | | |
|---|---|---|---|
| 3,872,665 | | 3/1975 | Jarry . |
| 3,946,556 | | 3/1976 | Catterfeld . |
| 4,862,820 | | 9/1989 | Guezou et al. . |
| 4,863,404 | * | 9/1989 | Salo ..... 440/38 |
| 4,917,637 | | 4/1990 | Soga et al. . |
| 5,045,004 | | 9/1991 | Kim . |
| 5,267,883 | | 12/1993 | Gudmundsen . |
| 5,439,402 | | 8/1995 | Dai et al. . |
| 5,476,401 | | 12/1995 | Peterson et al. . |
| 5,505,639 | | 4/1996 | Burg . |
| 5,558,509 | | 9/1996 | Jirnov et al. . |
| 5,591,057 | | 1/1997 | Dai et al. . |
| 5,598,700 | | 2/1997 | Varshay et al. . |
| 5,649,843 | | 7/1997 | Elger . |
| 5,692,371 | | 12/1997 | Varshay et al. . |

* cited by examiner

*Primary Examiner*—Jesus D. Sotelo
(74) *Attorney, Agent, or Firm*—Howard Kaiser

(57) ABSTRACT

The inventive apparatus exercises control of the water flow which is discharged from a marine waterjet propulsor. Typical inventive embodiments comprise plural horizontal and plural vertical blade-like structures which together describe an open-ended, box-like rectilinear configuration characterized by at least two adjacent channels. Every vertical blade-like structure includes, at its aft end, a "steering" flap which is pivotable about a vertical axis. Some inventive embodiments advance marine craft reversing by implementing one or more bucket-like devices behind the inventive apparatus. According to many inventive embodiments, every vertical blade-like structure (other than the two laterally extreme vertical blade-like structures) has a steering flap attributed with lengthwise severability (as if severed by a vertical plane) into two sub-flaps, each sub-flap itself being pivotable about the same vertical axis; in cooperation therewith, the marine craft is reversed by implementing plural "backing" flaps (included in the bottom-side horizontal blade-like structure or structures) which are each pivotable about a horizontal axis. The inventively coordinated movements and dispositions of the flaps, sub-flaps and/or bucket-like devices effect steerable and/or reversible maneuverability of the marine craft. Utilization of the present invention is especially efficacious in the context of waterjet propulsion systems wherein the water flow is discharged underwater; underwater-discharge marine waterjet propulsion, practically unknown but theoretically recognized for its potential benefits, is rendered a real and viable option by the present invention.

35 Claims, 14 Drawing Sheets

STEERING AND BACKING SYSTEMS FOR WATERJET CRAFT WITH UNDERWATER DISCHARGE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to waterjet propulsion, more particularly to the steering and reversing of waterjet propulsion systems for marine vessels such as ships.

Marine waterjet propulsion has increasingly gained acceptance in recent years, and has begun to challenge the long-established dominance of screw propellers. A waterjet-propelled craft is known to be capable of affording a superior maneuvering capability.

In fact, waterjet propulsion offers several advantages over conventional screw propellers, including the following: simplification of mechanical arrangement by eliminating reverse gears, a complicated mechanical device to change propeller pitch, and long propulsion shafting; flexibility of machinery arrangement and placement of machinery in the hull; improved maneuverability, especially the ability to turn at zero forward speed; and, elimination of external rudders, shafting and propellers, thereby improving shallow water operation.

However, several disadvantages are known to be associated with existing waterjet craft, which conventionally effectuate jet discharge in the air. A significant disadvantage is low propulsive efficiency at speeds less than about 25 knots. As a consequence, existing waterjets have been principally applied to high speed vessels at speeds between approximately 35 to 70 knots. Such waterjet designs suffer from poor performance at off-design speeds.

Peterson et al. U.S. Pat. No. 5,476,401 issued Dec. 19 1995, incorporated herein by reference, and Dai et al. U.S. Pat. No. 5,439,402 issued Aug. 8, 1995, incorporated herein by reference, disclose improvements pertaining to a conventionally abovewater waterjet system insofar as providing good hydrodynamic performance (e.g., high propulsive efficiency and good cavitation performance) both at low speeds and at high speeds.

The present invention is especially motivated by the need, discerned by the present inventors, to successfully effectuate waterjet propulsion underwater (into a water medium)—rather than abovewater (into an air medium), as is conventionally done. Jets on existing waterjet craft are typically discharged into the air. The present inventors recognize the benefits which a naval ship or commercial ship could enjoy by circumventing certain problems normally associated with waterjet discharge into the air. Notably, discharging the jets underwater would eliminate the resultant noise from the jets plunging into the sea, and would increase propulsive efficiency.

Nevertheless, conventional steering and backing systems for waterjet craft are effective for the familiar abovewater mode of jet discharge, but would be unsuitable for the unfamiliar underwater mode of jet discharge. Conventional waterjet steering/backing systems include outlet nozzles for receiving the accelerated flow from the pumps and discharging the jets in a rearward direction above the waterline. The steering/backing of the craft is typically accomplished by deflecting the jets using rotating steering sleeves or buckets. Hence, according to common practice, steering and backing systems use rotating sleeves to vector the jets for maneuvering. These types of devices would experience severe drag penalties in water. Moreover, the bulky sleeves would trigger severe cavitation.

Therefore, there is a need for a waterjet steering/backing system which is suitable for a waterjet craft having one or more jets discharged underwater.

SUMMARY OF THE INVENTION

In view of the foregoing, it is an object of the present invention to provide a steering and reversing system for a waterjet-propelled craft.

It is another object of the present invention to provide a steering and reversing system for a waterjet-propelled craft wherein a jet, or a plurality of jets, are discharged underwater.

A further object of the present invention is to provide, for an underwater-discharge waterjet-propelled craft, a steering and reversing system which is characterized by efficiency in terms of steering and maneuvering capability.

Another object of the present invention is to provide, for an underwater-discharge waterjet-propelled craft, a steering and reversing system which is relatively uncomplicated and economical.

The present invention provides a relatively simple waterjet steering system which is characterized by efficient capabilities in terms of steering and maneuvering. In particular, the present invention advantageously affords minimum drag and cavitation-free operation in straight course and during course-keeping maneuvering.

In accordance with typical embodiments of the present invention, a waterjet exit assembly comprises an upper horizontal wall, a lower horizontal wall and a plurality of approximately equidistantly spaced vertical walls. The upper horizontal wall, the lower horizontal wall and the vertical walls form a plurality of adjacent channels for the waterjet. The waterjet exit assembly also comprises a plurality of horizontally pivotable vertical flaps, wherein each vertical wall includes a vertical flap. Each vertical flap is capable of deflecting to selected dispositions with respect to its corresponding vertical wall.

According to typical inventive practice, the vertical walls include two lateral vertical walls and at least one medial vertical wall. Each medial vertical wall includes a vertical flap which is a divisible vertical flap, which is divisible into two horizontally pivotable demiflaps. Each demiflap is capable of deflecting to selected dispositions with respect to its corresponding medial vertical wall. Many inventive embodiments are characterized by two channels, three vertical walls and three flaps.

Generally, the present invention is implemented in association with waterjet means characterized by the capability of accelerating water and discharging the accelerated water in a manner suitable or adaptable for propelling a marine vessel. According to typical inventive practice, the waterjet means will comprise a water-accelerative mechanism of a kind which includes at least one pump; nevertheless, the present invention can be used in association with any kind of waterjet means having the requisite capability.

According to frequent practice of this invention, water is introduced into two adjacent waterjet pumps, and exits via two respective accelerated flow discharge nozzles. The accelerated flow is then controlled by the inventive steeringand-backing apparatus, which includes two adjacent flow-straightening chambers. Each flow-straightening chamber includes its own sidewall flap. Also, both flow-straightening chambers share a longitudinally divisible (splitable) medial sidewall flap. The three sidewall flaps are used for jet direction vectoring, thereby effectuating steering.

Depending on the inventive embodiment, backing is effectuated according to either of two inventive methodologies. According to some inventive embodiments, a set of rotating buckets is implemented in the transom stern for flow reversing. According to other inventive embodiments, bottom wall flaps are implemented for flow reversing; each flow-straightening chamber includes a bottom wall flap. Some inventive embodiments can be provided, in the alternative, with both flow reversing capabilities.

Featured by this invention is the provision of sidewall flaps which serve to vector the jet direction for steering and maneuvering. The sidewall flaps are parts of the dual flow-straightening exit chamber assembly. The two lateral sidewall flaps are each a part of one such flow exit chamber, while the single medial sidewall flap is shared by both flow exit chambers and is capable of splitting into two medial semi-flaps. Each lateral sidewall flap is embedded in a lateral sidewall. The medial sidewall flap is embedded in the medial sidewall.

Sidewall flap deflection is inventively effectuated without leading edge protrusion into the flow, thereby avoiding cavitation. Many inventive embodiments provide a flexible seal at the front part of each sidewall flap to avoid gap cavitation. The inventive steering system thus succeeds in vectoring the jets without causing cavitation during the course-keeping maneuvering.

Further featured by the present invention is the provision of two alternative backing methodologies, each of which is cooperative with the inventive steering methodology. In order to reverse the direction of the discharged jets for purposes of effecting backing operations, this invention can utilize: (i) a deployable bucket; or, (ii) two bottom wall flaps, each of which is part of a respective flow-straightening chamber.

Many inventive embodiments provide a hydrodynamically designed and integrated hull-and-waterjet propulsion system. Such inventive embodiments feature an integrated stem which incorporates a pump drive with steering and reversing devices. The inventively integrated hull-and-steering system beneficially affords minimum drag and cavitation-free course-keeping operation.

As mentioned hereinabove, for certain marine applications (e.g., naval applications) it is desirable that the waterjet be discharged underwater. The fluid density of water is about 900 times greater than that of air. The present invention is particularly efficacious in the context of underwater-discharge waterjet propulsion systems.

By comparison, conventional steering systems implementing rotating sleeves, used extensively in existing waterjet craft, generally work adequately in air but would experience tremendous drag or resistance in water; in addition, the bulky rotating sleeves would produce severe cavitation in water. If a conventional steering system were used for a waterjet craft with the jets discharged underwater, the craft would suffer drag and possibly cavitation on the steering devices at high speeds; the craft would have poor hydrodynamic performance.

The multifarious applicability of the present invention admits of transportation in any water or marine environment, locality or milieu. The terms "water" and "marine," as used herein, are synonymous, and pertain to any body of water, natural or man-made, including but not limited to oceans, seas, gulfs, lakes, harbors, canals, rivers, straits, etc.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

DETAILED DESCRIPTION OF THE INVENTION

Figure 1:
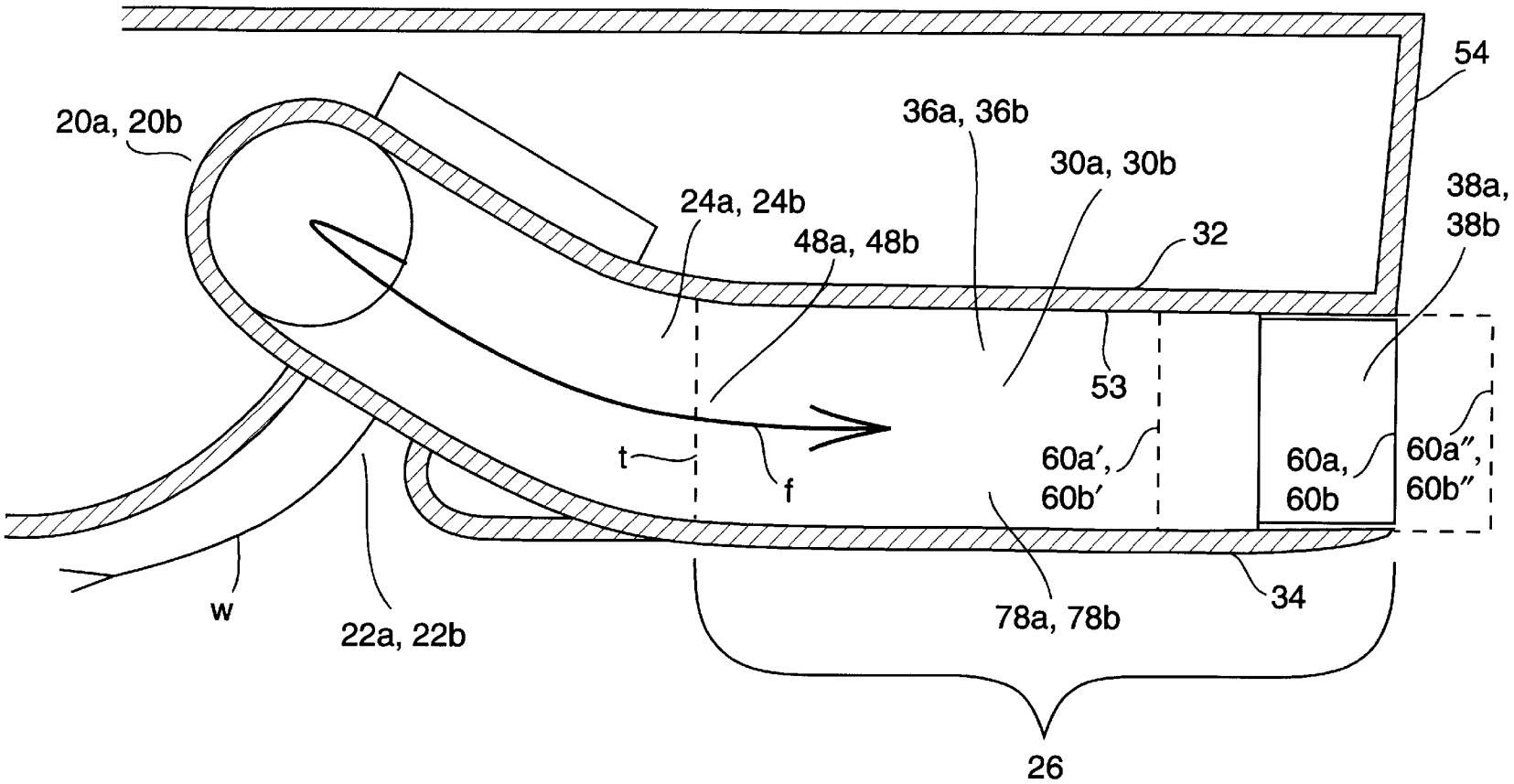
FIG. 1 is a diagrammatic side elevation view of an embodiment of the present invention, showing one waterjet pump, its corresponding exit nozzle and its corresponding flow-straightening exit chamber.
Figure 2:
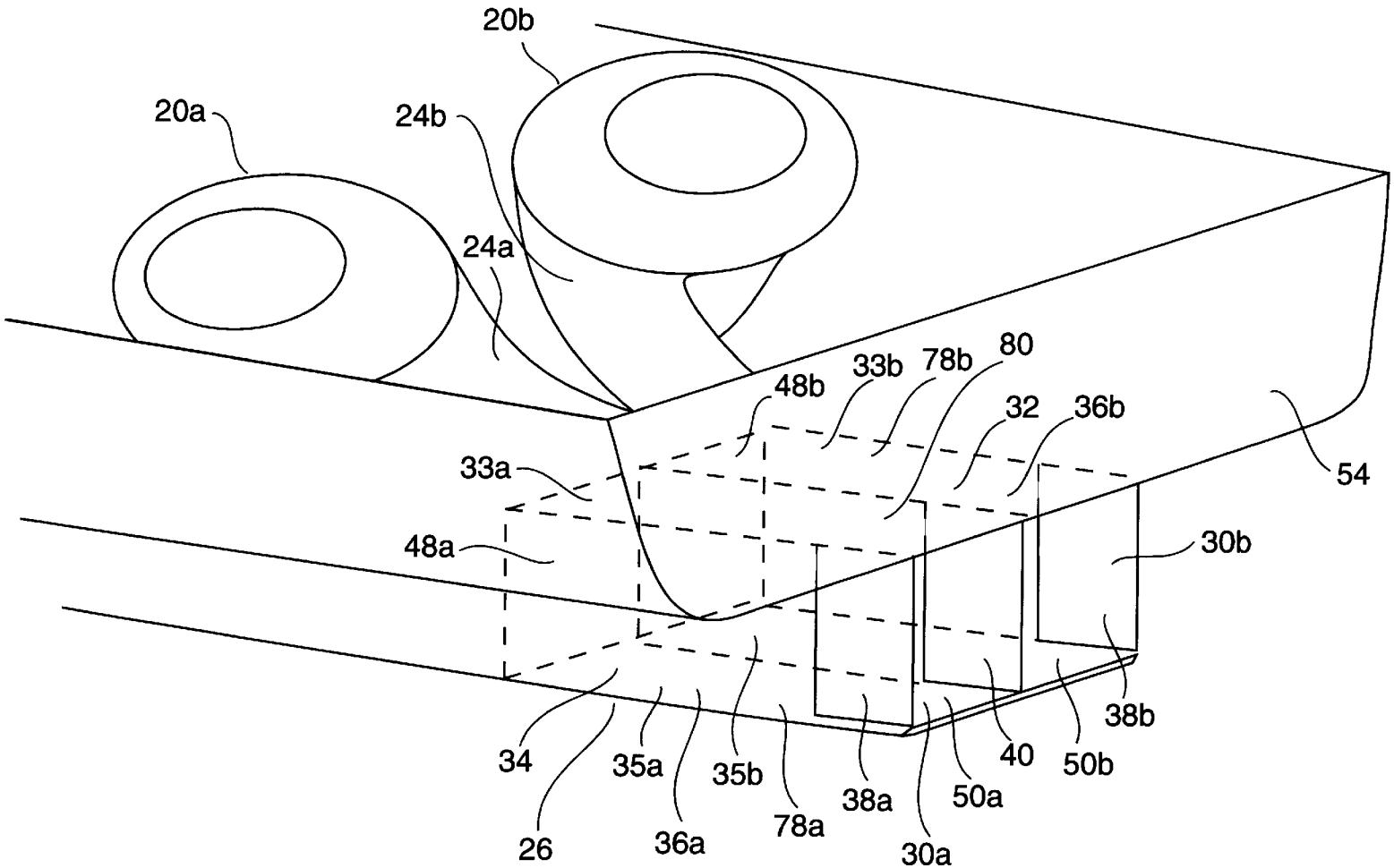
FIG. 2 is a diagrammatic rear perspective view, partially cutaway, of the inventive embodiment depicted in FIG. 1, showing both waterjet pumps and their corresponding flow-straightening exit chambers.

Referring now to FIG. 1 and FIG. 2, juxtaposed are a pair of adjacent waterjet pumps 20*a* and 20*b*. Waterjet pump 20*a* includes a flush inlet 22*a* and an outlet (exit) nozzle 24*a*; waterjet pump 20*b* includes a flush inlet 22*b* and an outlet (exit) nozzle 24*b*. The unaccelerated water w enters waterjet pumps 20*a* and 20*b* through the corresponding flush inlets 22*a* and 22*b*. The accelerated water f exits from waterjet pumps 20*a* and 20*b* through the corresponding outlet nozzles 24*a* and 24*b*.

The accelerated water flow f enters inventive flow exit assembly 26. Inventive flow exit assembly 26 describes a box-like rectilinear configuration which is approximately equally divided by medial sidewall 28 into two adjacent, approximately equivalent "flow-straightening" flow exit chambers 30*a* and 30*b*. Flow exit chamber 30*a* and flow exit chamber 30*b* serve to "straighten" the flow received, respectively, from outlet nozzle 24*a* (of waterjet pump 20*a*) and outlet nozzle 24*b* (of waterjet pump 20*b*). Chamber 30*a* is associated with waterjet pump 20*a*; chamber 30*b* is associated with waterjet pump 20*b*. Because FIG. 1 presents a side view, or a mirror-imaged opposite-side view, only one waterjet pump and one chamber are visible in this figure.

Inventive flow exit assembly 26 includes the following "walls," each of which is approximately or substantially planar: medial sidewall 28, topwall 32, bottomwall 34, lateral sidewall 36*a* and lateral sidewall 36*b*. Topwall 32 and bottomwall 34 are approximately parallel and approximately congruent. Medial sidewall 28, lateral sidewall 36*a* and lateral sidewall 36*b* are approximately parallel and approximately congruent.

Topwall 32 includes topwall portions 33*a* and 33*b*. Bottomwall 34 includes bottomwall portions 35*a* and 35*b*. Flow exit chamber 30*a* is bounded by lateral sidewall 36*a*, medial sidewall 28, topwall portion 33*a* and bottomwall portion 35*a*. Flow exit chamber 30*b* is bounded by lateral sidewall 36*b*, medial sidewall 28, topwall portion 33*b* and bottomwall portion 35*b*. Thus, inventive flow exit assembly 26 includes medial sidewall 28, topwall portion 33*a*, bottomwall portion 35*a*, sidewall 36*a*, topwall portion 33*b*, bottomwall portion 35*b* and sidewall 36*b*.

Chambers 30*a* and 30*b* are each characterized by a rectangular tubular shape formed by a horizontal topwall, a horizontal bottomwall and two vertical sidewalls. Chambers 30*a* and 30*b* share medial sidewall 28. In addition to sharing medial sidewall 28 with chamber 30*b*, chamber 30*a* also has topwall portion 30*a*, bottomwall portion 35*a* and lateral sidewall 36*a*. In addition to sharing medial sidewall 28 with chamber 30*a*, chamber 30*b* also has topwall portion 33*b*, bottomwall portion 35*b* and lateral sidewall 36*b*.

Inventive flow exit assembly 26 approximately defines a rectangular parallelepiped which is longitudinally split by vertical medial sidewall 28, approximately down the middle, into two approximately identically shaped chambers 30*a* and 30*b*. Still with reference to FIG. 1 and FIG. 2 and especially with reference to FIG. 3 and FIG. 4, chamber 30*a* has an interior chamber width $w_{Ca}$, and chamber 30*b* has an interior chamber width $w_{Cb}$, wherein $w_{Ca}$ is approximately equal to $w_{Cb}$. Inventive flow exit assembly 26 has a total exit assembly width $w_T$ which approximately equals the sum of $w_{Ca}$ plus $w_{Cb}$ plus the sum of the widths of sidewalls 36*a*, 36*b* and 28.

Figure 3:
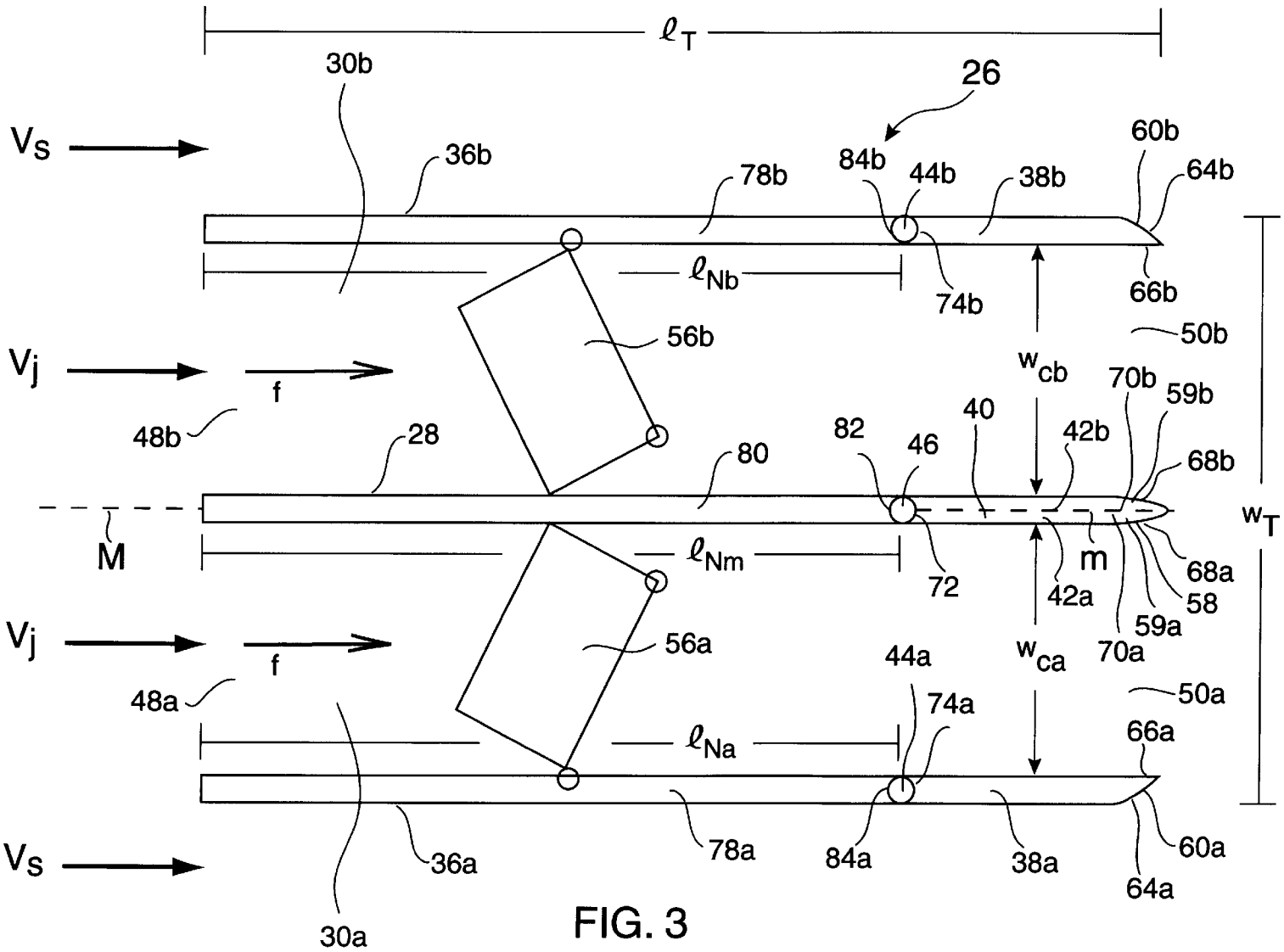
FIG. 3 is a diagrammatic top plan view, partially cutaway, of an inventive embodiment such as depicted in FIG. 1, showing the flow-straightening exit chambers and their corresponding steering flaps, particularly illustrating operation of an inventive steering system wherein the marine vessel is navigating in straight course.

When the bottomwall flaps are in undeflected condition (or are not included) such as shown in FIG. 1, topwall 32 and bottomwall 34 are approximately congruent and are approximately parallel. Topwall portion 33*a*, topwall portion 33*b*, bottomwall portion 35*a* and bottomwall portion 35*b* are approximately congruent. Topwall portion 33*a* and topwall portion 33*b* lie approximately in the same plane. Bottomwall portion 35*a* and bottomwall portion 35*b* lie approximately in the same plane. Topwall portion 33*a* and bottomwall portion 35*a* are approximately parallel. Topwall portion 33*b* and bottomwall portion 35*b* are approximately parallel. When the sidewall flaps and flap subsections are in undeflected condition such as shown in FIG. 3, sidewall 28, sidewall 36*a* and sidewall 36*b* are approximately congruent and are approximately parallel.

Still with reference to FIG. 1 through FIG. 4, lateral sidewall 36*a* includes, as integral parts thereof, lateral sidewall non-flap section 78*a* and lateral sidewall flap 38*a*. Lateral sidewall 36*b* includes, as integral parts thereof, lateral sidewall non-flap section 78*b* and lateral sidewall flap 38*b*. Medial sidewall 28 includes, as integral parts thereof, medial sidewall non-flap section 80 and medial sidewall flap 40.

The "flap" sections of lateral sidewall 36*a*, lateral sidewall 36*b* and medial sidewall 28, respectively, are lateral sidewall flap 38*a*, lateral sidewall flap 38*b* and medial sidewall flap 40. The "non-flap" sections of lateral sidewall 36*a*, lateral sidewall 36*b* and medial sidewall 28, respectively, are lateral sidewall non-flap section 78*a*, medial sidewall non-flap section 80, and lateral sidewall non-flap section 78*b*. As indicated by dashed line m and as later discussed herein in relation to FIG. 10, medial sidewall flap 40 is longtitudinally divisible into two approximately equal flap subsections 42*a* and 42*b*. The marine vessel's longitudinal axis of symmetry is indicated by dashed line M. As shown in FIG. 3, when medial sidewall 28 is in an undeflected condition, dashed lines m and M lie approximately in the same vertical plane.

Figure 4:
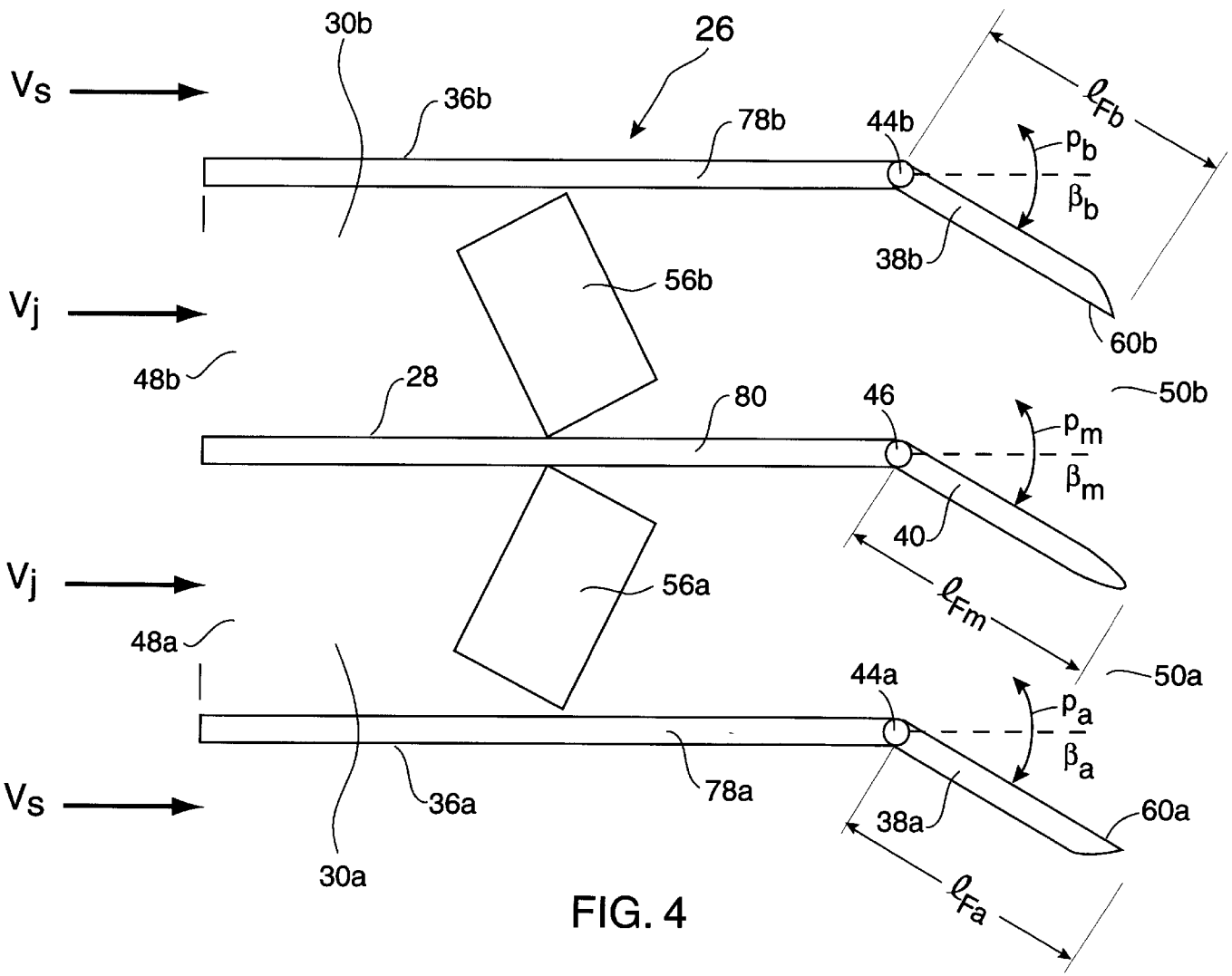
FIG. 4 is diagrammatic top plan view (similar to the view in FIG. 3) of the inventive embodiment shown in FIG. 3, particularly illustrating operation of an inventive steering system wherein the marine vessel is navigating in a turn.
Figure 9:
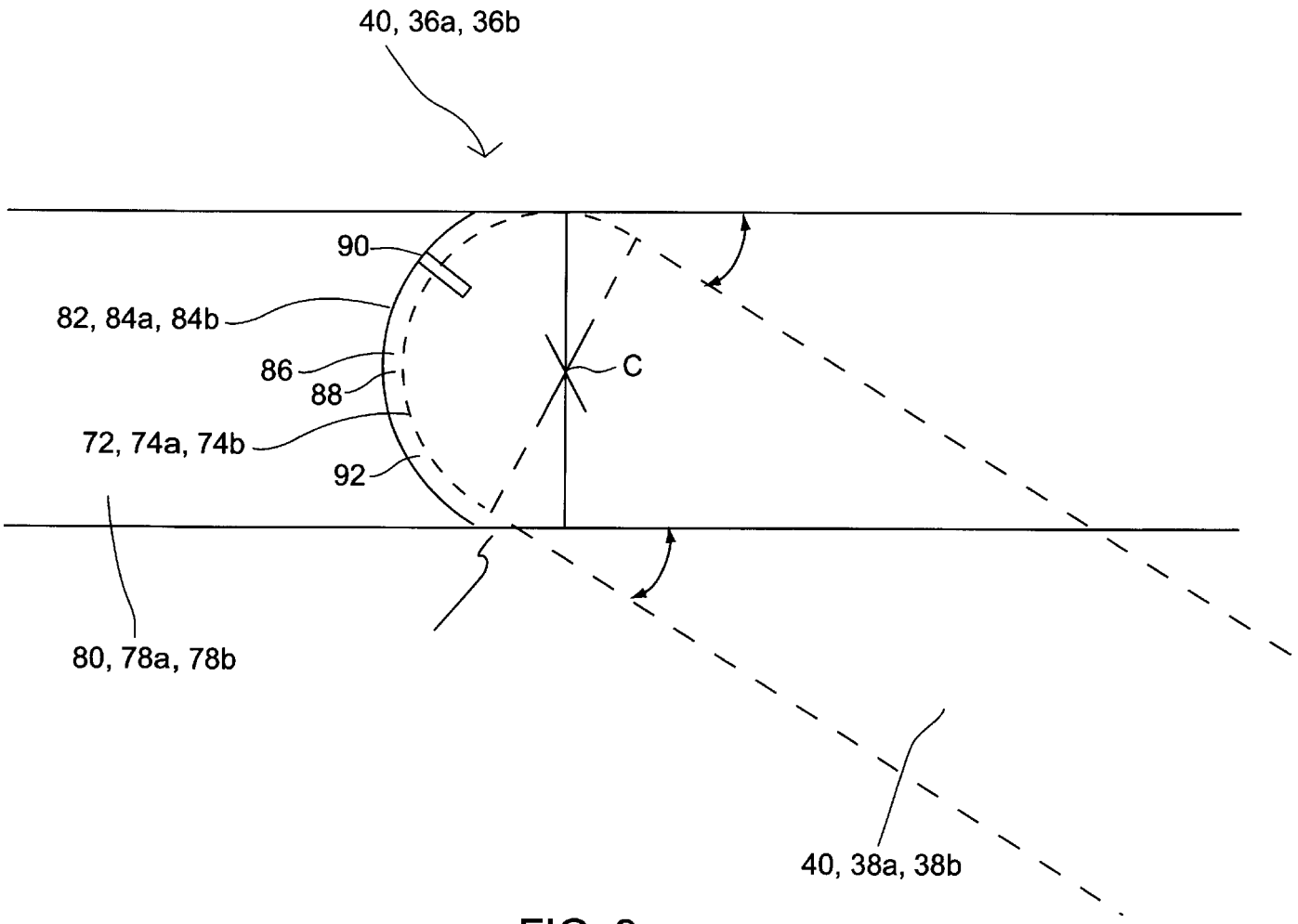
FIG. 9 is a partial, enlarged diagrammatic top plan view of an inventive sidewall such as represented in FIG. 3 and FIG. 4, showing the leading edge portion of the inventive sidewall flap, particularly illustrating deflection of the inventive sidewall flap.

Lateral sidewall flap 38*a* is horizontally pivotable (at least about plus-or-minus thirty degrees as shown in FIG. 4 by angle $\beta_a$ and bidirectional arrow $p_a$) about vertical pivot 44*a*. Lateral sidewall flap 38*b* is horizontally pivotable (at least about plus-or-minus thirty degrees as shown in FIG. 4 by angle $\beta_b$ and bidirectional arrow $p_b$) about vertical pivot 44*b*. Medial sidewall flap 40 is horizontally pivotable (at least about plus-or-minus thirty degrees as shown in FIG. 4 by angle $\beta_m$ and bidirectional arrow $p_m$) about vertical pivot 46. Vertical pivots 46, 44*a* and 44*b* each turn about a central axis c such as shown in FIG. 9.

The two chambers 30*a* and 30*b* are hence separated by medial sidewall 28 whereby lateral sidewalls 36*a* and 36*b* are approximately parallel to medial sidewall 28 and to each other. Chambers 30*a* and 30*b* are used to smooth out vortex generated by pumps 20*a* and 20*b*, respectively. Chambers 30*a* and 30*b* receive the water from pumps 20*a* and 20*b*, respectively, at chamber inlet ends 48*a* and 48*b*. Chambers 30*a* and 30*b* discharge the water at chamber outlet ends 50*a* and 50*b*, respectively. The water is thus discharged by chambers 30*a* and 30*b* underwater at the transom stern 54 such as shown in FIG. 2.

As shown in FIG. 2, according to generally preferred inventive practice, the inventive steering/maneuvering system is integrated into the ship hull to ensure a minimum ship resistance. Topwall 32 (which includes topwall portions 33*a* and 33*b*) is made an integral part of an area of hull bottom 53 in the vicinity of transom stern 54. Sidewall flap trailing edges 58, 60*a* and 60*b*, topwall 32, bottomwall 34 and transom stern 54 are shown to all be approximately even or coextensive. According to the integrated arrangement characteristic of many inventive embodiments, pumps 20*a* and 20*b* smoothly transition into chambers 30*a* and 30*b*; the pump outlet nozzles 24*a* and 24*b* effectively merge or blend into the chamber inlet ends 48*a* and 48*b*, respectively, the conversion occurring approximately at the location indicated by dashed line t shown in FIG. 1.

It can be considered that there are at least two basic approaches to practicing the present invention. According to a first approach, a marine vessel (and, in particular, its propulsion system) is originally designed ("on the drawing board") as being inclusive of the present invention, and is then constructed in accordance therewith. This "integral" approach, wherein the inventive apparatus is "built into" the marine vessel as part thereof (e.g., made an integral part of the hull) during fabrication of the marine vessel, will frequently yield cost savings and greater hydrodynamic efficiency, in comparison with the second approach.

According to the second approach, an existing marine vessel (and, in particular, its propulsion system) is adapted to being inclusive of the present invention. Generally, the existing marine vessel must be changed in one or more respects in order to accommodate or comport with the inventive apparatus. This "retrofit" approach, wherein the inventive apparatus is attached to, mounted on or otherwise coupled with the marine vessel so as to appropriately engage the waterjet mechanism, will normally be expected to entail a degree of structural alteration of the existing marine vessel construction (e.g., of the hull and/or the waterjet pumping mechanism); frequently, this structural alteration will include that of the waterjet mechanism (e.g., the waterjet pump or pumps), especially the outlet ends thereof, so as to be rendered harmonious with the inventive apparatus, especially the inlet ends thereof.

Regardless of how the inventive apparatus is caused to be associated with a marine vessel, it is generally an inventive objective to optimize (or at least account for) the hydrodynamic and propulsive effects and ramifications of the inventive arrangement in the context of the marine vessel. The inventive practitioner should appropriately regard the hydrodynamic "flow lines" and contours of the marine vessel as a whole, and particularly of the configuration involving the engagement of the inventive apparatus with the waterjet apparatus. Generally speaking, hydrodynamic efficiency of the marine vessel will be more readily attained or advanced when the inventive apparatus is incorporated into the marine vessel as part of the original design of the marine vessel (such as illustrated in FIG. 1 and FIG. 2), as compared with when the inventive apparatus is retrofittedly incorporated into the marine vessel.

Outlet nozzles 24*a* and 24*b* are shown in FIG. 1 and FIG. 2 to be diametrically or perimetrically equivalent to, and indistinguishably (or virtually indistinguishably) consolidated with, chamber inlet ends 48*a* and 48*b*; this inventive configuration is more typically associated with embodiments wherein the marine vessel's propulsion system is designed from the start with the present invention in mind. When the inventive apparatus is retrofitted with respect to an existing waterjet mechanism, the configuration of the waterjet mechanism in combination with the inventive apparatus may perhaps be more often typified by a lesser degree of geometric regularity in the vicinity of the junctions between the waterjet outlet nozzles and the inventive flow chambers' inlet ends.

Inventive practice will generally dictate that, in order to suitably couple the waterjet mechanism with the inventive apparatus, the waterjet's outlet nozzles "fit" (i.e., be geometrically congruous with) the inventive flow chamber(s)'s inlet ends. Regardless of whether the inventive apparatus is design-integratively or retrofittedly provided, connective compatibility will usually be characterized by relative apertural sizes wherein the cross-sectional areas of the flow chambers' inlet ends are greater than or equal to the cross-sectional areas of the waterjet outlet nozzles, and wherein the former are encompassing of the latter. In other words, the waterjet outlet nozzles should be diametrically or perimetrically agreeable with the flow chambers' inlet ends, and should be rendered in appropriate engagement therewith.

Sidewall flap trailing edge 58, sidewall flap trailing edge 60*a*, sidewall flap trailing edge 60*b*, topwall 32 and bottomwall 34, though preferably being approximately even or coextensive with respect to each other, need not be approximately even or coextensive with respect to transom stern 54. Generally in inventive practice, the chambers can be even/coextensive with respect to the transom/stern (such as exemplified in FIG. 1 by a chamber 30*a* having flap trailing edge 60*a*), or recessed with respect to the transom/stem (such as exemplified in FIG. 1 by a chamber 30*a* having a flap trailing edge 60*a*'), or protrusive with respect to the transom/stem (such as exemplified in FIG. 1 by chamber 30*a* having a flap trailing edge 6*a*").

The spatial relation of the inventive apparatus's aft end with respect to the marine vessel's stem is a factor to be considered in the overall design of the invention for a particular use, especially in terms of hydrodynamics and propulsion. For instance, whether the aft end of the inventive apparatus is even with the stem, or whether and how much (e.g., at what distance) the aft end of the inventive apparatus is forward of or aft of or even with the stem, should figure in the evaluation of the inventive apparatus's desired configuration in terms of lengths, angles, etc.

Shown in FIG. 3, FIG. 4, FIG. 10 and FIG. 11 are two kinds of inventive maneuvering devices, viz.: (i) sidewall flaps 40, 38*a* and 38*b*, used for steering; and, (ii) bottomwall flaps 56*a* and 56*b*, used for backing. Every such flap is made an integral part of a corresponding wall of inventive flow exit assembly 26: Medial sidewall flap 40 is imbedded in medial sidewall 28; lateral sidewall flap 38*a* is imbedded in lateral sidewall 36*a*; lateral sidewall flap 38*b* is imbedded in lateral sidewall 36*b*; bottomwall flap 56*a* is imbedded in bottomwall 34*a*; bottomwall flap 56*b* is imbedded in bottomwall 34*b*.

It is reemphasized that, rather than implementing bottomwall flaps imbedded in the bottom walls of the flow exit chambers, such as bottomwall flaps 56*a* and 56*b*, the present invention can effectuate the backing aspect of maneuverability via an alternative methodology using a convexo-concave structure such as one known as a "bucket." According to the inventive "bucket" methodology, a deployable bucket is stored in the transom stern. Hence, some inventive embodiments do not include bottomwall flaps for backing purposes, but instead utilize a bucket-type structure such as further discussed hereinbelow in relation to FIG. 12 through FIG. 15. Some inventive embodiments may include bottomwall flaps and additionally include a bucket-type structure, as well as the associated means for effectuating either mode of backing.

The back ends of sidewalls 28, 36*a* and 36*b* are not blunt trailing edges; rather, the back ends of sidewall flaps 40, 38*a* and 38*b* are curved to avoid flow separation and to reduce ship resistance. Sidewall flaps 40, 38*a* and 38*b* have curvilinear trailing edges 58, 60*a* and 60*b*, respectively. Lateral trailing edges 60*a* and 60*b* each describe a partially curved, partially straight shape.

Lateral trailing edge 60*a* defines an arcuate exterior surface portion 64*a* of sidewall flap 38*a*, in combination with a truncating linear interior surface portion 66*a* of sidewall flap 38*a*; similarly, lateral trailing edge 60*b* defines an arcuate exterior surface portion 64*b* of sidewall flap 38*b*, in combination with a truncating linear interior surface portion 66*b* of sidewall flap 38*b*.

Medial trailing edge 58 describes a substantially curved shape. Medial trailing edge 58 defines the combination of an arcuate surface portion 68*a* of medial sidewall flap 40 and an arcuate surface portion 68*b* of medial sidewall flap 40. Dashed line m represents the junction between medial sidewall flap subsection (e.g., half-section) 42*a* and medial sidewall flap subsection (e.g., half-section) 42*b*.

As later discussed herein in relation to FIG. 10, medial sidewall flap subsections 42*a* and 42*b* are capable of separating for effectuating closure of the sidewall flaps (for purposes of reversing flow in order to achieve backing of the marine vessel); when this occurs, it can be considered that medial sidewall flap subsection 42*a* has medial subsection trailing edge 59*a*, and that medial sidewall flap subsection 42*b* has medial subsection trailing edge 59*b*. Medial subsection trailing edge 59*a* defines the combination of arcuate surface portion 68*a* with a truncating linear surface portion 70*a*; similarly, medial subsection trailing edge 59*b* defines the combination of arcuate surface portion 68*b* with a truncating linear surface portion 7*b*.

Figure 10:
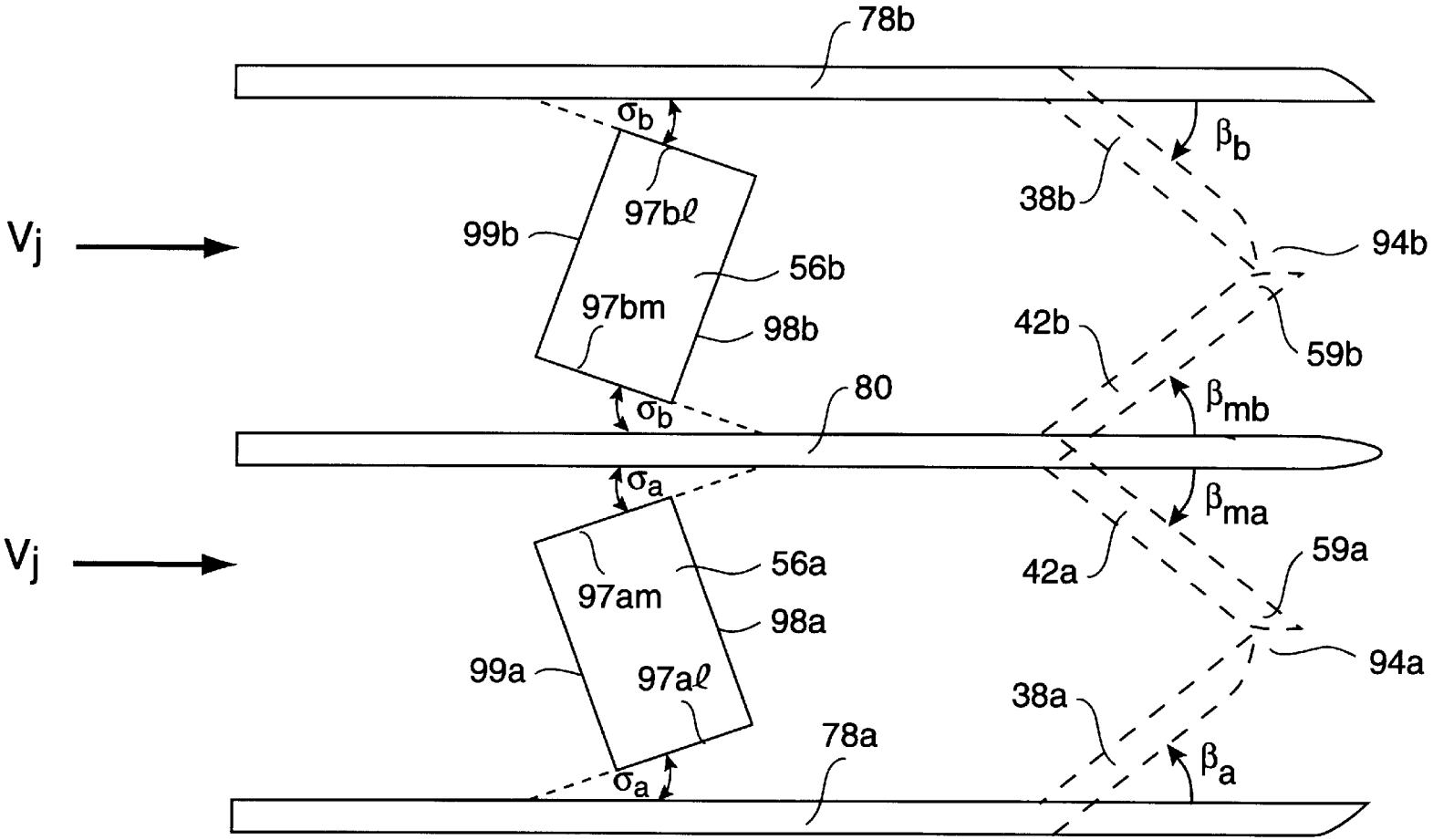
FIG. 10 is a diagrammatic top plan view (similar to the views in FIG. 3 and FIG. 4) of the inventive embodiment shown in FIG. 3 and FIG. 4, showing the flow-straightening exit chambers and their corresponding backing (bottom) flaps, particularly illustrating operation of an inventive backing system wherein (in conjuction with opening of the bottom flaps as shown in FIG. 11) the steering (sidewall) flaps are closed for reversing flow to the forward direction, thereby effecting reversal of the marine vessel.

As viewed in FIG. 3, FIG. 4 and FIG. 10, the flow f is from left to right. The ship speed is designated $V_S$. The jet speed (the "jet" or water flow inside a chamber 30*a* or 30*b*) is designated $V_J$. Typically, the jet speed $V_J$ is approximately 20% to 60% higher than the ship speed $V_S$. The steering devices (sidewall flaps 40, 38*a* and 38*b*) and the backing devices (bottomwall flaps 56*a* and 56*b*) are imbedded in the flow exit chambers 30*a* and 30*b*.

Still referring to FIG. 3 and especially referring to FIG. 4, sidewall flaps 40, 38*a* and 38*b* have rotatable medial leading edge 72, rotatable lateral leading edge 74*a* and rotatable lateral leading edge 74*b*, respectively. The axis of rotation is centric to each leading edge of the corresponding sidewall flap. The ordinarily skilled artisan is well acquainted with the mechanics pertaining to the rotation of ship rudders; similar mechanics are inventively implemented to rotate the sidewall flaps. A rotating device is conventionally used to deflect a ship rudder, and variations thereof are well known in the marine industry.

While the marine craft is operating in a straight course, sidewall flaps 40, 38*a* and 38*b* remain even or nearly even with their respective sidewalls (sidewalls 28, 36*a* and 36*b*, respectively) and bottomwall flaps 56*a* and 56*b* remain even or nearly even with their respective bottomwall portions (bottomwall portions 34*a* and 34*b*, respectively, as shown in FIG. 2). Flap angle β is the angle formed by each sidewall flap with its respective sidewall. Every sidewall flap deflects at approximately the same flap angle β at approximately the same time (i.e., approximately synchronously). That is, as shown in FIG. 4, flap deflection angle $\beta_a$ approximately equals flap deflection angle $\beta_b$.

In typical inventive practice, during normal straight course-keeping, every flap angle β shifts constantly, simultaneously (i.e., approximately synchronously) and equally (i.e, approximately parallelly) within an approximate range of plus or minus 5 or 6 degrees (i.e., in a range between no more than about five or six degrees to one side of the sidewall and no more than about five or six degrees to the opposite side of the sidewall). In this manner, sidewall flaps 40, 38*a* and 38*b* and bottomwall flaps 56*a* and 56*b* are flushly or nearly flushly disposed in their respective sidewalls, without significant protrusion to the flow; hence, practically no additional or unwanted drag is incurred in association with the present invention.

With particular reference to FIG. 4, when the waterjet craft is called for turning maneuver, sidewall flaps 38*a*, 38*b* and 40 are each deflected to approximately the same flap angle β and approximately synchronously, thereby vectoring the jet. It is readily appreciated, in consideration of FIG. 4, that the sidewall flaps will be rotated to flap angle β in the direction opposite that shown, in order that the craft be turned in the other direction.

Typical inventive practice provides that, when effectuating sharp (wide) turns, every flap angle β shifts simultaneously (i.e., approximately synchronously) and equally (i.e., approximately parallelly) to an equivalent deflective position (with respect to its corresponding sidewall) which is up to a maximum value of about 20 or 30 degrees (i.e., between about twenty or thirty degrees to one side of the sidewall). Hence, generally during inventive practice involving normal navigation (whether effecting straight course-keeping, moderate turns or extreme turns), it can be expected that every flap angle β will shift virtually identically and concurrently within an approximate range of plus or minus 30 degrees (i.e., in a range between no more than about thirty degrees to one side of the sidewall and no more than about thirty degrees to the opposite side of the sidewall). Therefore, according to typical inventive embodiments, the sidewall flaps will have the capability of deflecting at a plus-and-minus angle β of at least thirty degrees.

The value of the angle β which is inventively effectuated for achieving particular maneuvers varies among inventive applications, depending upon factors including (i) the size and weight of the marine vessel and (ii) the configuration of the inventive waterjet apparatus.

Figure 5:
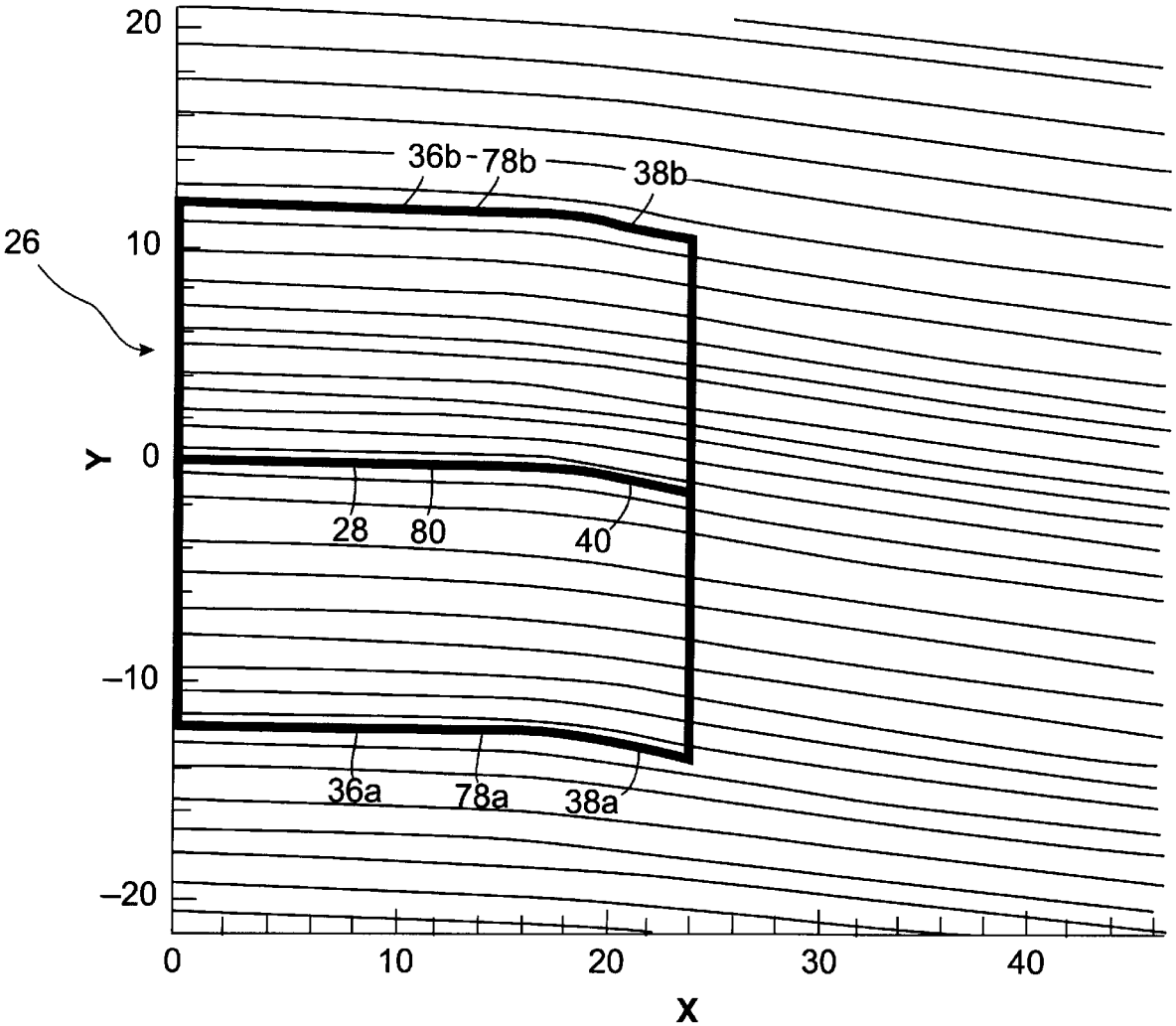
FIG. 5 is a graphical representation of the calculated flow streamline distributions, wherein the three sidewall flaps are deflected by ten degrees, and the flap length equals six feet.

Reference now being made to FIG. 5, shown are the streamline distributions along the surfaces of the sidewalls and the sidewall flaps, wherein all three sidewall flaps are deflected by ten degrees. This 10° flap angle is selected merely as exemplary.

FIG. 5 provides a spatial representation, in top plan perspective, of lateral sidewall 36*a* (including lateral sidewall flap 38*a*), medial sidewall 28 (including medial sidewall flap 40) and lateral sidewall 36*b* (including lateral sidewall flap 38*b*). The distance in the fore-and-aft direction, commencing at the extreme fore end of the sidewall (designated X=0), is represented as the horizontal axis of graph, and is designated "X." The distance in the port-and-starboard direction is represented as the vertical axis of graph, and is designated "Y."

It is seen in FIG. 5 that each sidewall flap has a flap length $l_F$ equal to about six feet, that each sidewall non-flap section has a non-flap length $l_N$ equal to about eighteen feet, and that each sidewall flap has a flap deflection angle β equal to about ten degrees. In accordance with typical inventive embodiments, every sidewall flap has approximately the same flap length $l_F$, and every sidewall non-flap section has approximately the same non-flap length $l_N$. Thus as shown in FIG. 3 through FIG. 5, flap length $l_{Fa}$, flap length $l_{Fb}$ and flap length $l_{Fm}$ are approximately equal. Similarly, non-flap length $l_{Na}$, non-flap length $l_{Nb}$ and non-flap length $l_{Nm}$ are approximately equal. Inventive flow exit assembly 26 has a total exit assembly length $l_T$ which approximately equals the sum of $l_F$ plus $l_N$.

As clearly illustrated by FIG. 5, the jet streamline distributions are effectively deflected by the sidewall flaps. As discussed hereinbelow, the significant flow entrainment outside the jet area greatly enhances the steering capability of the present invention.

Figure 6:
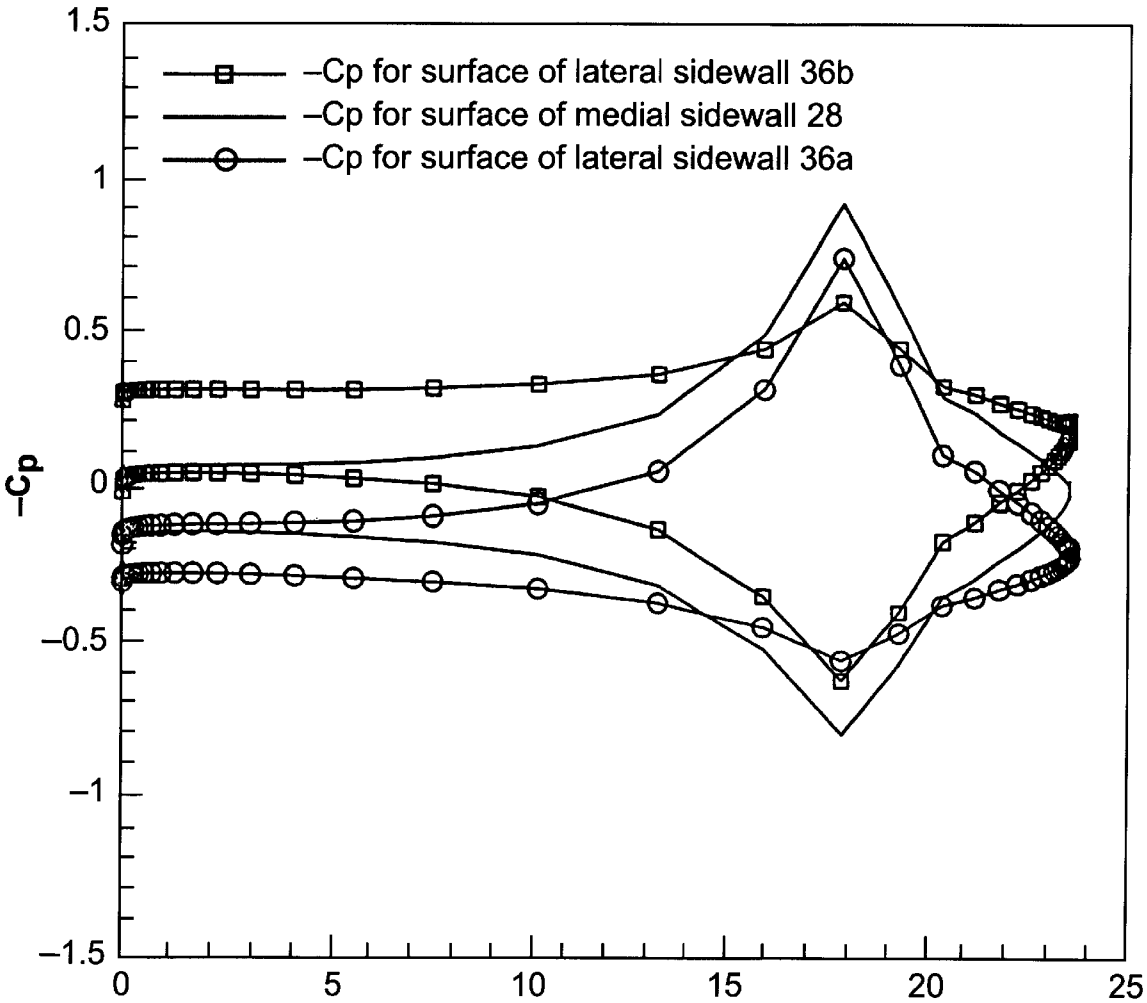
FIG. 6 is a graphical representation of the calculated pressure distributions, wherein the three sidewall flaps are deflected by ten degrees, and the flap length equals six feet.
Figure 7:
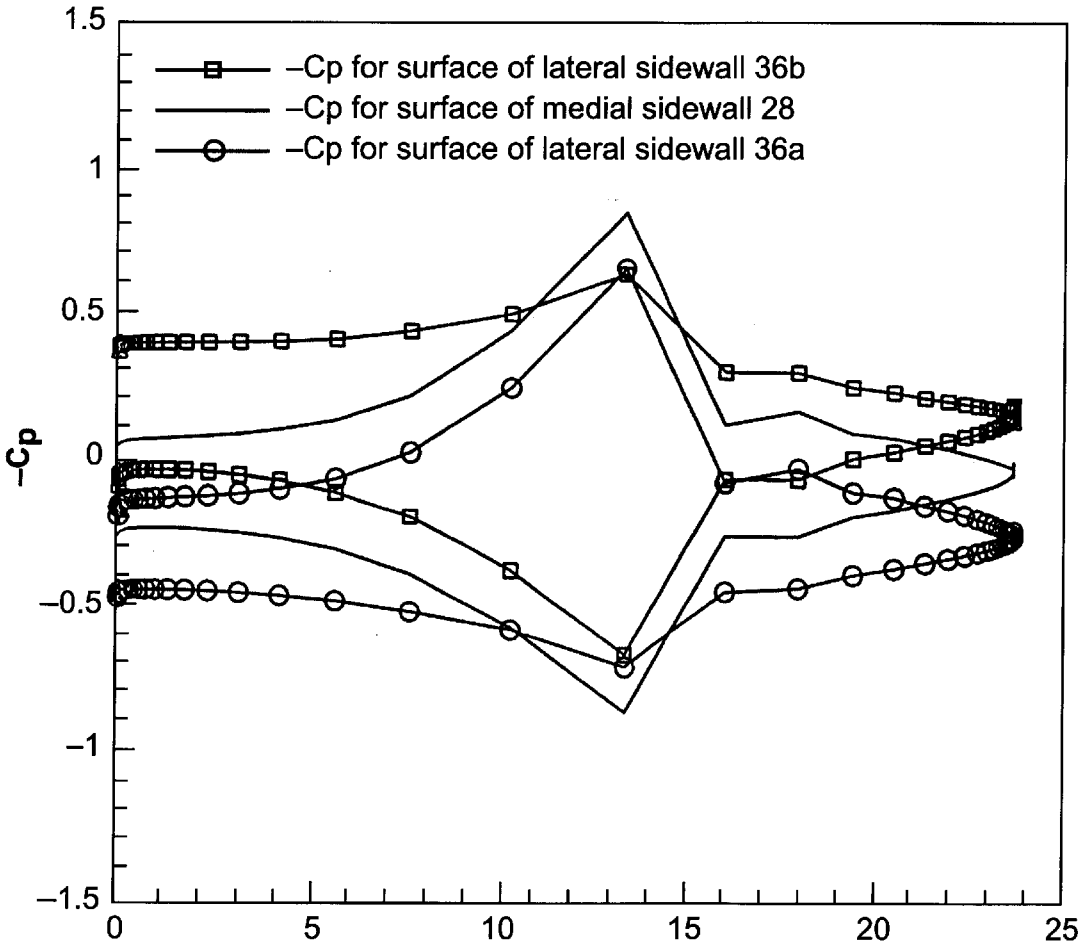
FIG. 7 is a graphical representation (similar to the graphical representation in FIG. 6) of the calculated pressure distributions, wherein the three sidewall flaps are deflected by ten degrees, and the flap length equals twelve feet.
Figure 8:
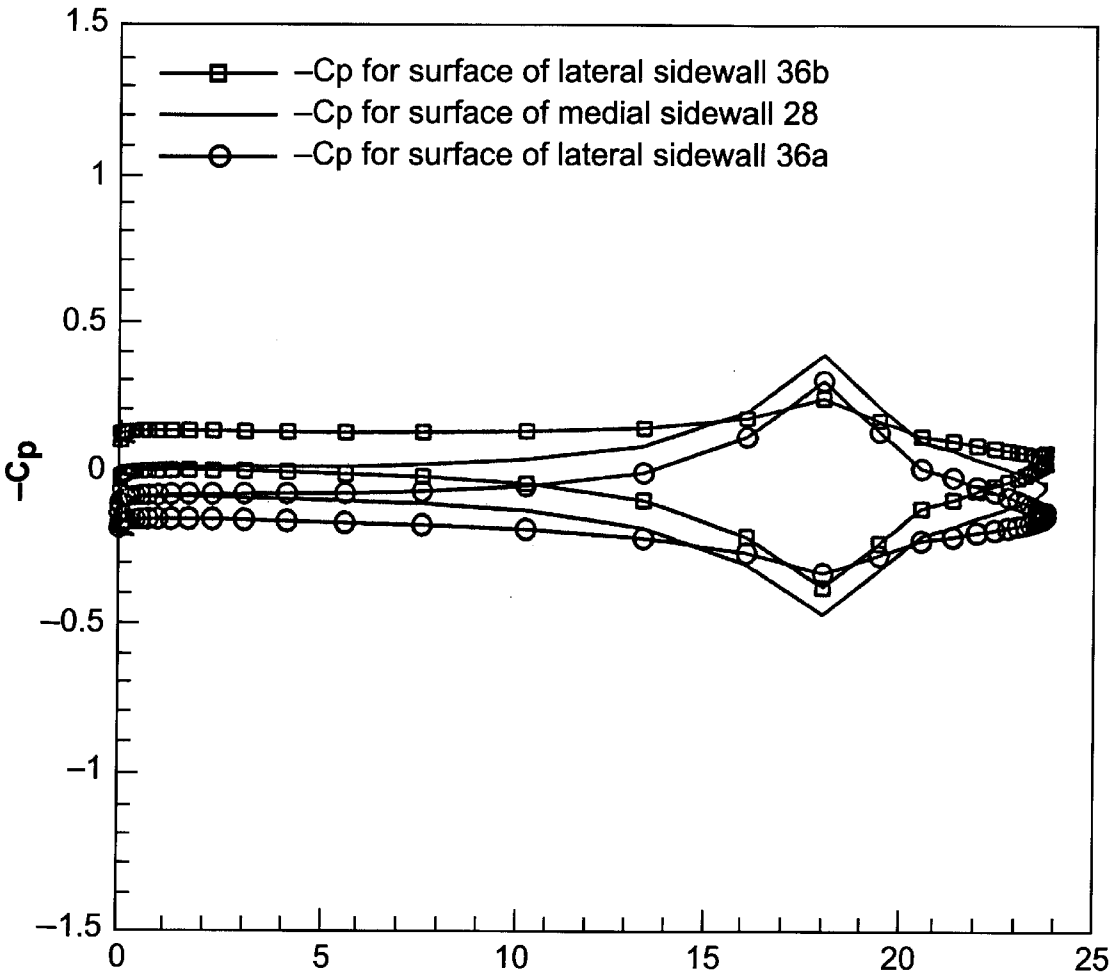
FIG. 8 is a graphical representation (similar to the graphical representations in FIG. 6 and FIG. 7) of the calculated pressure distributions, wherein the three sidewall flaps are deflected by five degrees, and the flap length equals six feet.

With reference to FIG. 6, FIG. 7 and FIG. 8, shown in each figure is the computed pressure distribution along the sidewalls and the sidewall flaps. A graphical display of pressure distributions, such as shown in each figure, provides a very useful mathematical tool. The graph can reveal the degree of cavitation susceptibility of a steering system. Moreover, the graph exhibits the physics of side force-producing mechanics among the various steering components.

In each of FIG. 6 through FIG. 8, the computed pressure ("minimum pressure coefficient" or "suction pressure peak") is represented as the vertical axis of the graph, and is designated "$-C_p$." The distance in the fore-and-aft direction, commencing at the extreme fore end of the sidewall (designated X=0), is represented as the horizontal axis of graph, and is designated "X."

The David Taylor Navier Stokes (DTNS) code has been used in the present calculations. There are many Navier Stokes codes available in the marine and aerospace industries. In the light of this disclosure, it is well understood by the ordinarily skilled artisan that any Navier Stokes code capable of solving the fluid problem with adequate numerical accuracy can be used. By integrating the pressure distributions along the sidewalls and the sidewall flaps, the side force due to flap deflection can be computed. By adjusting the flap deflection angle, the required side force can be generated. By integrating the pressure distributions along the flap, the required torque to rotate the flap can be determined.

As shown in each of FIG. 6 through FIG. 8, suction pressure peaks are generated at the flap leading edge. The suction pressure peak $-C_p$ is often termed the "minimum pressure coefficient" in the marine industry. By comparing the minimum pressure coefficient $-C_p$ and the cavitation number, cavitation inception speed and cavitation inception flap angle of a steering system can be evaluated. A cavitation-free steering system is obtained if the minimum pressure coefficient is less than the cavitation number. The definition of cavitation number is well known in the marine industry, and no further discussion thereof need be given herein. If the minimum pressure coefficient is greater than the cavitation number, the design parameters as discussed hereinbelow must be adjusted.

Generally, according to the present invention's design process, design parameters including the following can be adjusted to obtain the desired side force: (i) sidewall flap length, such as flap length $l_F$ shown in FIG. 3 through FIG. 5; (ii) sidewall flap deflection angle, such as flap deflection angle β shown in FIG. 4 and FIG. 5; (iii) jet exit area; (iv) the static water head in the jet exit location; and, (v) jet velocity with respect to the ship speed. The torque to rotate the flap can be obtained by integrating the pressure distributions around the flap.

The effects of design parameters on side force and pressure distributions are illustrated by comparing the graph shown in FIG. 6 with the graphs shown in FIG. 7 and FIG. 8. Consideration of FIG. 6 versus FIG. 7 reveals the effect of flap length $l_F$. Consideration of FIG. 6 versus FIG. 8 reveals the effect of flap angle β.

FIG. 7 vis-a-vis' FIG. 6 manifests how the change in flap length affects the pressure distributions. The flap length $l_F$ shown in FIG. 7 is twice the flap length $l_F$ shown in FIG. 6. The side force is found to be nineteen percent (19%) higher in FIG. 7 than in FIG. 6. The suction pressure peak which is shown in FIG. 6 is found in FIG. 7 (wherein the flap length is doubled) to be slightly reduced.

FIG. 8 vis-a-vis' FIG. 6 manifests how the change in flap angle affects the pressure distributions. The design parameters used in FIG. 8 are the same as in FIG. 6 except that flap angle β is decreased by half, to five degrees (5°). The side force shown in FIG. 8 is approximately fifty-four percent (54%) of the side force shown in FIG. 6. The suction pressure peak shown in FIG. 8 is substantially lower than the suction pressure peak shown in FIG. 6.

Inventive procedures similar to those described herein in relation to FIG. 6 through FIG. 8 can be effectuated so as to vary other design parameters, such as jet velocity and jet exit area. Based on the inventive design process, the required side force and cavitation-free operation can be evaluated, and a desirable steering system can be obtained. However, the inventive design parameters can have a significant effect on design of the pump. Accordingly, the inventive design methodology generally requires close interaction with the pump design.

Results from numerical calculations demonstrate that, because of the flow entrainment outside of the jet area, the present invention can produce a side force which is substantially higher than the side force which is produced by the jet momentum alone. For example, the side force produced by a side wall flap deflection angle β of ten degrees (10°), as given in FIG. 7, is found to be ninety-two percent (92%) higher than the side force produced by the jet momentum associated with the sleeves used in a conventional waterjet steering system. This represents an important advantage of the present invention.

Another advantage of the present invention is that the magnitude of the suction pressure peak in the mid-flap is greatly alleviated due to the neighboring flaps. The inventive steering system having multi-flaps thus can operate at higher speeds without cavitation than can a steering system having a conventional rudder.

A naval ship with a high-speed capability greater than thirty (30) knots is not uncommon. At such a high speed, any physical protrusion from the steering system in the flow can easily cause cavitation to occur. To circumvent this problem, the sidewall flaps in accordance with the present invention are specially designed.

Referring again to FIG. 3 and FIG. 4 and also referring to FIG. 9, medial sidewall flap 40 has rotatable medial leading edge 72; lateral sidewall flap 38*a* has rotatable lateral leading edge 74*a*; and lateral sidewall flap 38*b* has rotatable lateral leading edge 74*b*. Medial sidewall non-flap section 80 has cavity-like medial trailing edge 82; lateral sidewall non-flap section 78*a* has cavity-like lateral trailing edge 84*a*; and lateral sidewall non-flap section 78*b* has cavity-like lateral trailing edge 84*b*. Flap length $l_F$ is approximately the length measurement from medial leading edge 72 to medial trailing edge 58 (flap length $l_{Fm}$), which is approximately the length measurement from lateral leading edge 74*a* to lateral trailing edge 60*a* (flap length $l_{Fa}$), which is approximately the length measurement from lateral leading edge 74*b* to lateral trailing edge 60*b* (flap length $l_{Fb}$).

FIG. 9 provides an enlarged depiction of the conjunction of the rotatable leading edge portion of a sidewall flap with the cavity-like trailing edge portion of its associated (upstream) sidewall non-flap section. The rotatable flap leading edge and the cavity-like trailing edge engage in a kind of "ball-and-socket" configuration; as shown in ball-and-socket joint mechanism 86, the rotatable flap leading edge is the "ball" to the cavity-like trailing edge "socket." The flap leading edge shown in FIG. 9 is representative of any of the three flap leading edges shown in FIG. 3 and FIG. 4, viz., 72, 74*a* or 74*b*; similarly, the cavity-like trailing edge shown in FIG. 9 is representative of any of the three non-flap trailing edges shown in FIG. 3 and FIG. 4, viz., 82, 84*a* or 84*b*.

As shown in FIG. 9, the flap leading edge approximately defines the shape of a circular arc. The non-flap trailing edge also approximately defines the shape of a circular arc. In the context of ball-and-socket joint mechanism 86, the arcuate shape of the non-flap trailing edge concentrically comports with the arcuate shape of the flap leading edge. The axis of rotation is the central axis c of the circular arcs (approximate semicircles) defined by both the flap leading edge and the non-flap trailing edge.

Gap 88 is interposed between the circularly arcuate flap leading edge and the circularly arcuate non-flap trailing edge. Gap 88 is filled by bearings (such as bearing 90) and gasket 92 so that no flow proceeds through gap 88 when the flap is deflected. The seal afforded by bearings 90 and gasket 92 provides a smooth flow transition from the upstream sidewall non-flap section to the flap. Consequently, the flap geometry around the flap's leading edge is smooth and continuous. Such a continuous surface, even with the flap deflected, will further reduce the magnitude of the suction pressure peak as shown in FIG. 6, FIG. 7 and FIG. 8. Accordingly, inventive practive further improves cavitation-free operation through efficacious implementation of fluid-tight seals and circular arcs in the junctional design of the flap and its associated non-flap.

Reference is now made to FIG. 10, which provides a top view of a reversing flow system in accordance with the present invention. Medial sidewall flap 40 is separable (splittable) into sidewall flap subsections 42*a* and 42*b*. Chambers 30*a* and 30*b* are shown to be closed by sidewall flap 38*a*, sidewall flap 38*b* and medial flap 40 (in particular, via the division, as if cleaved by a vertical planar cleaver, of medial flap 40 into flap subsections 42*a* and 42*b*).

Such closure of chambers 30*a* and 30*b*, generally for purposes of effecting backward motion of the marine vessel, is inventively accomplished as follows: Lateral sidewall flap 38*a* (rotatable about a central axis c such as shown in FIG. 9) deflects inward (i.e., toward medial sidewall flap 40) at flap deflection angle $\beta_a$; lateral sidewall flap 38*b* (rotatable about a central axis c such as shown in FIG. 9) deflects inward (i.e., toward medial sidewall flap 40) at flap deflection angle $\beta_b$; medial sidewall flap subsection 42*a* (rotatable about a central axis c such as shown in FIG. 9) deflects outward (i.e., toward lateral sidewall flap 38*a*) at flap deflection angle $\beta_{ma}$; medial sidewall flap subsection 42*b* (rotatable about a central axis c such as shown in FIG. 9) deflects outward (i.e., toward lateral sidewall flap 38*b*) at flap deflection angle $\beta_{mb}$.

Flap angles $\beta_a$ and $\beta_b$ are the angles formed by each sidewall flap with its respective sidewall. Flap angles $\beta_{ma}$ and $\beta_{mb}$ are the angles formed by each sidewall flap subsection with its respective sidewall. According to many inventive embodiments, when effectuating closure, every sidewall flap and sidewall flap subsection deflects at an approximately equal angle $\beta$, wherein a first half of the flaps and a first half of the flap subsections are approximately parallel to each other, and wherein a second half of the flaps and a second half of the flap subsections are approximately parallel to each other; the flaps and flap subsections of the first half are obliquely disposed with respect to the flaps and flap subsections of the second half.

As shown in FIG. 10, lateral sidewall flap 38*a* obliquely meets medial sidewall flap subsection 42*a* at juncture 94*a* and is approximately parallel to medial sidewall flap subsection 42*b*. Similarly, lateral sidewall flap 38*b* obliquely meets medial sidewall flap subsection 42*b* at juncture 94*b* and is approximately parallel to medial sidewall flap subsection 42*a*. As shown in FIG. 3, sidewall flaps 38*a*, 38*b* and 40 are approximately parallel to each other when in an undeflected condition. Therefore, as shown in FIG. 10, flap deflection angle $\beta_a$ approximately equals flap deflection angle $\beta_{ma}$, and flap deflection angle $\beta_b$ approximately equals flap deflection angle $\beta_{mb}$.

Moreover, many inventive embodiments effectuate closure wherein every flap and flap subsection deflects at about the same angle $\beta$. Hence, as shown in FIG. 10, flap deflection angle $\beta_a$, flap deflection angle $\beta_{ma}$ flap deflection angle $\beta_b$ and flap deflection angle $\beta_{mb}$ are all approximately equal. During closure, the value of flap deflection angle $\beta$ depends upon the value of sidewall flap length $l_F$ and the value of chamber width $w_C$. In accordance with the majority of inventive embodiments, it is assumed that every sidewall flap has about the same flap length $l_F$, and that every flow chamber has about the same chamber width $w_C$. For instance, if the length $l_F$ of each sidewall flap is half of each chamber width $w_C$, a flap deflection angle $\beta$ of thirty degrees (30°) blocks the flow completely.

Figure 11:
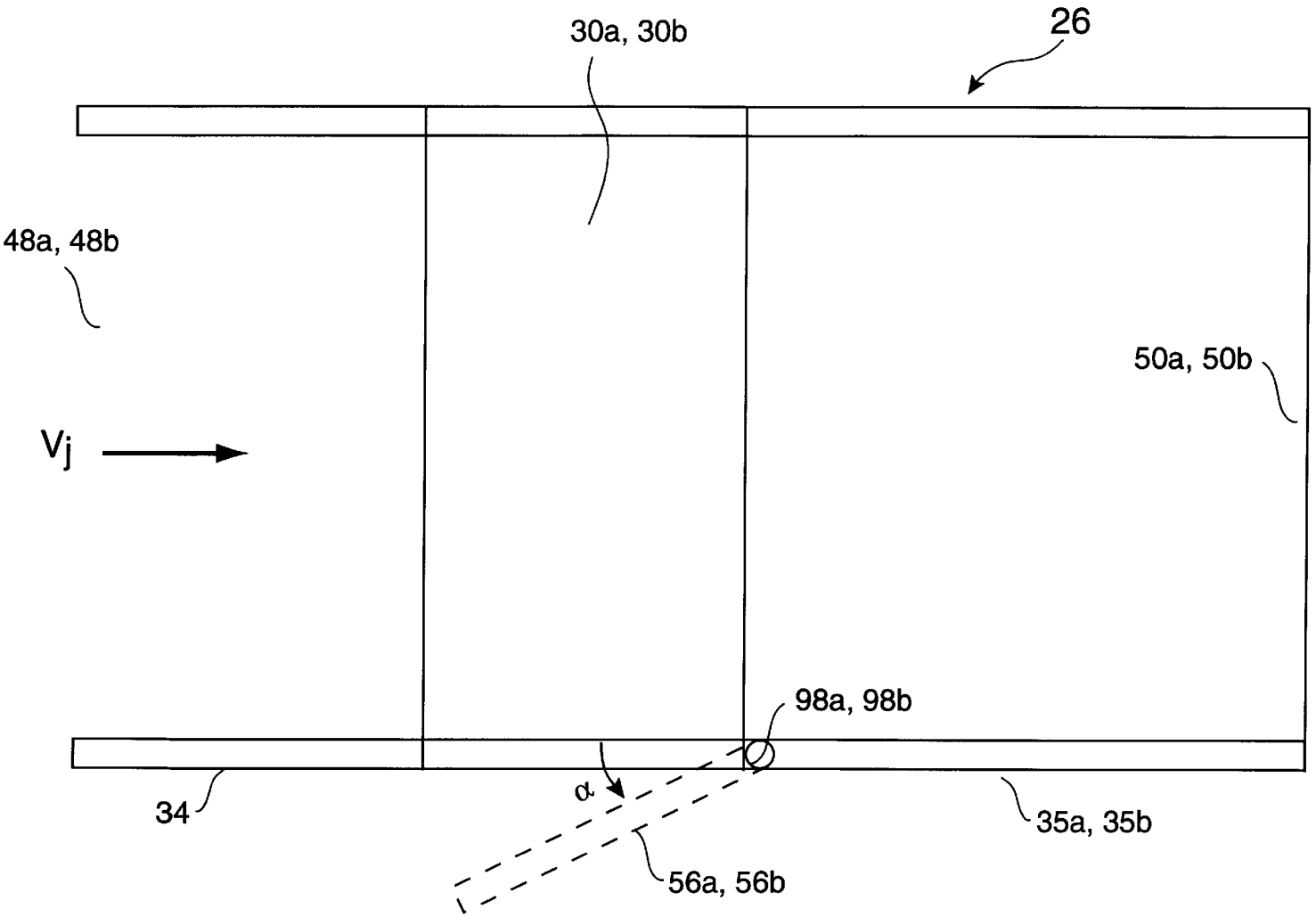
FIG. 11 is diagrammatic side elevation view of the inventive embodiment as shown operating in FIG. 10, particularly illustrating operation of the inventive backing system wherein (in conjuction with closure of the sidewall flaps as shown in FIG. 10) the bottom flaps are opened for reversing flow to the forward direction, thereby effecting reversal of the marine vessel.

Reference is now made to FIG. 11, which provides a side view of the inventive reversing flow system shown in FIG. 10. "Twin" bottomwall flaps 56*a* and 56*b* are opened, as shown in FIG. 11, for ship reversing—i.e., to reverse the water flow for backing of the marine vessel. Flap deflection angle $\alpha$ is the angle formed by each bottomwall flap with bottomwall 34. Angle $\alpha$ shown in FIG. 11 can be considered to be representative of either bottomwall flap 56*a* or bottomwall flap 56*b*. Although not explicitly depicted in the figures, it is readily understood that each of bottomwall flaps 56*a* and 56*b* has associated therewith its own flap deflection angle $\alpha$; in other words, it is readily envisioned that bottomwall flap 56*a* has associated therewith a flap deflection angle $\alpha_a$, and bottomwall flap 56*b* has associated therewith a flap deflection angle $\alpha_b$.

Bottomwall flap 56*a* has a bottomwall flap trailing edge 98*a*. Bottomwall flap 56*b* has a bottomwall flap trailing edge 98*b*. It is readily appreciated, in the light of this disclosure, that sealed rotatability of bottomwall flaps 56*a* and 56*b* can be inventively practiced in a manner similar to that described hereinabove in relation to FIG. 9. Similarly as shown in FIG. 9, each bottomwall flap trailing edge 98 approximately defines the shape of a circular arc. Each arcuate bottomwall flap trailing edge 98 engages a compatible arcuate edge portion provided in bottomwall 34 as included in a kind of pivotable ball-and-socket joint mechanism such as mechanism 86 shown in FIG. 9. The axis of rotation is the center (similar to center c shown in FIG. 9) of the circular arcs. Again, the ordinarily skilled artisan is familiar with methodologies, known in pertinent marine arts, suitable for incorporating into the inventive practice of the fluid-tight bottomwall flap rotational mechanism.

The degree of downward rotation (i.,e., bottomwall flap deflection angle $\alpha$) depends upon the marine craft's operational requirements, particularly with regard to stopping distance. If possible, the deflection angle $\alpha$ of the bottom flaps should be small to enhance the breaking force. On the other hand, if the bottomwall flap angle $\alpha$ is too small, the flow may be choked and the backing capability thereby degraded. Accordingly, the designing of the backing system in accordance with the present invention generally involves a "tradeoff" between these two competing considerations.

For typical inventive embodiments, each bottomwall flap will defect downward to a maximum angle $\alpha$ in the range between about thirty degrees (30°) and about forty-five degrees (45°). A value within this range of values (thirty to forty-five degrees) for bottomwall flap deflection angle $\alpha$ will provide optimum efficiency for most inventive embodiments.

Frequently according to inventive practice, when effectuating backing (reversing) maneuvers, every bottomwall flap shifts downward from bottomwall 34 simultaneously (i.e., approximately synchronously) and equally (i.e., approximately parallelly) to an equivalent deflective angle $\alpha$ position beneath bottomwall 34. However, some inventive embodiments provide for a backing system wherein at least two bottomwall flaps are capable of being adjusted individually, thereby deflecting independently to different angles $\alpha$. This inventive approach, wherein at least two bottomwall flaps can independently deflect to disparate angles $\alpha$, serves to afford additional maneuvering capability during the backing of the marine vessel.

Referring again to FIG. 10, it is seen that, in the horizontal plane approximately defined by bottomwall 34, each of bottomwall flaps 56*a* and 56*b* is obliquely angled with respect to the sidewalls, that is, with respect to the incoming flow. This inventive feature, wherein each bottomwall flap is characterized by an oblique angle $\theta$, is especially useful when implemented in conjunction with the independent deflection of two or more bottomwall flaps to different angles $\alpha$, and thereby serves to enhance the marine vessel's maneuvering capability during the backing thereof As shown in FIG. 10, bottomwall flaps 56*a* and 56*b* are each approximately rectangular, each having a trailing edge (98*a* and 98*b*, respectively), a leading edge (99*a* and 99*b*, respectively) and two side edges (97*al* and 97*am*, and 97*bl* and 97*bm*, respectively). Bottomwall flap 56*a* (more specifically, side edge 97*al* with respect to lateral sidewall 36*a*, and side edge 97*am* with respect to medial sidewall 28) forms an angle $\theta_a$ with respect to lateral sidewall 36*a* and medial sidewall 28; similarly, bottomwall flap 56*b* (more specifically, side edge 97*bl* with respect to lateral sidewall 36*b*, and side edge 97*bm* with respect to medial sidewall 28) forms an angle $\theta_b$ with respect to lateral sidewall 36*b* and medial sidewall 28.

For typical inventive embodiments, each bottomwall flap will be situated at an oblique dispositional angle $\theta$ which is in the range between about twenty degrees (20°) and about thirty degrees (30°). A value within this range of values (twenty to thirty degrees) for bottomwall flap oblique dispositional angle $\theta$ will provide optimum efficiency for most inventive embodiments.

With regard to independent control of flaps, it is appreciated by analogy that this invention can provide for a steering system wherein at least two sidewall flaps are capable of being adjusted individually, thereby deflecting independently to different angles $\beta$; however, such capacity in association with the sidewall flaps generally lacks the operational utility afforded by such capacity in association with the bottomwall flaps.

Figure 12:
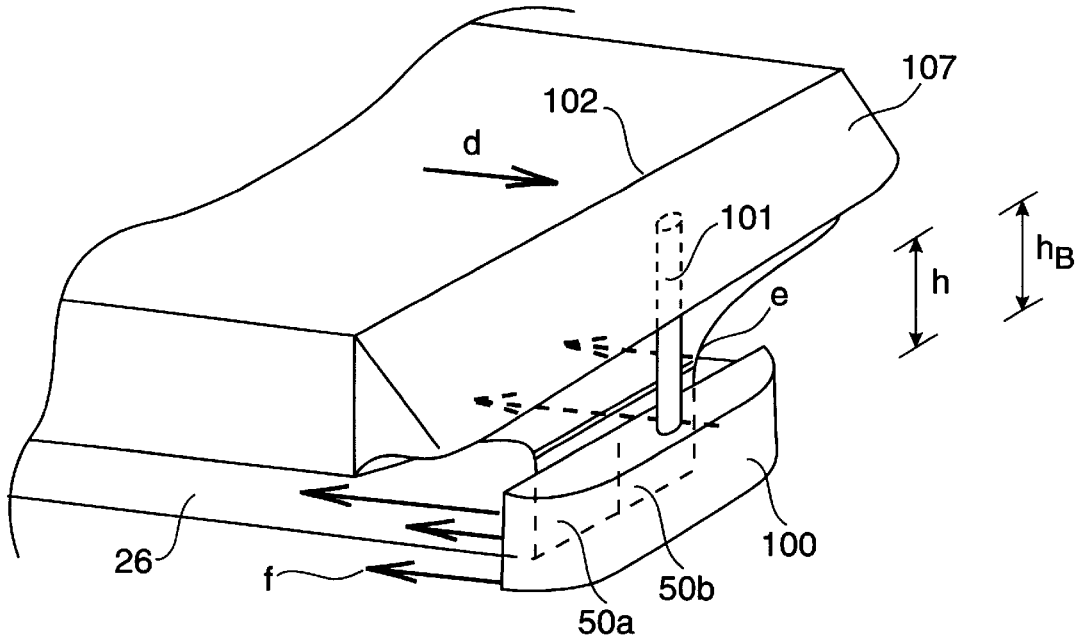
FIG. 12 is diagrammatic rear perspective view, partially cutaway, of an inventive embodiment, different from that shown operating in FIG. 10 and FIG. 11, showing the flow-straightening exit chambers and a bucket, particularly illustrating operation of an inventive backing system wherein the bucket is deployed for reversing flow to the forward direction, thereby effecting reversal of the marine vessel.
Figure 13:
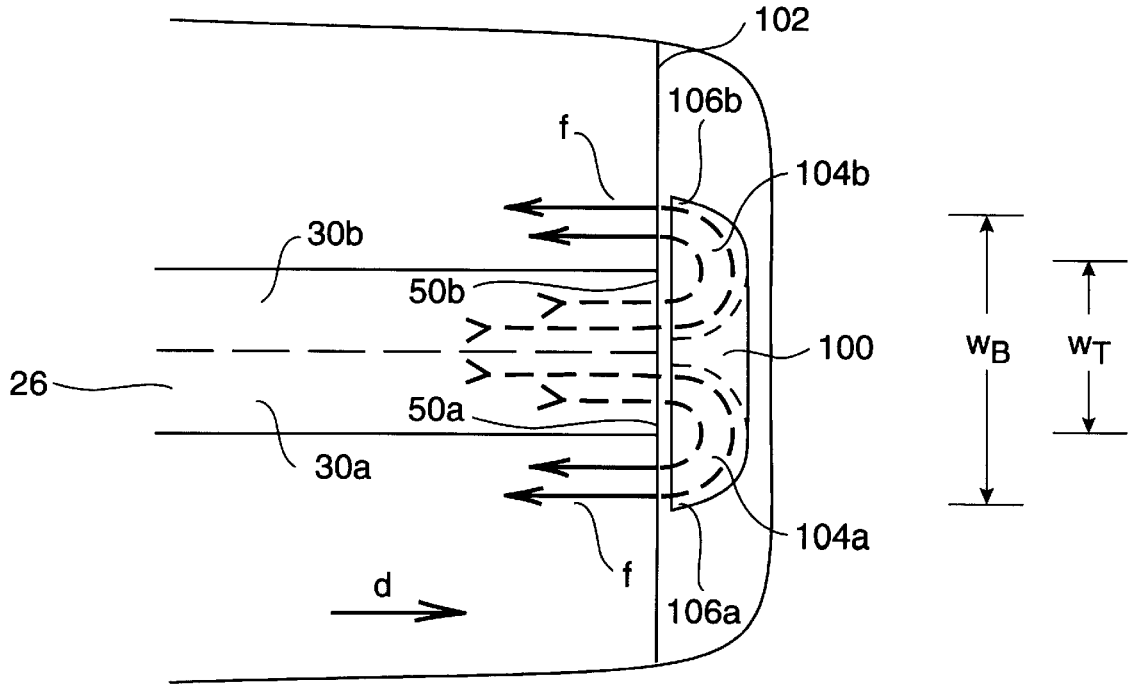
FIG. 13 is diagrammatic bottom plan view, partially cutaway, of the inventive embodiment shown operating in FIG. 12, particularly illustrating operation of the inventive backing system wherein the bucket is deployed for effecting straight backing of the marine vessel.
Figure 14:
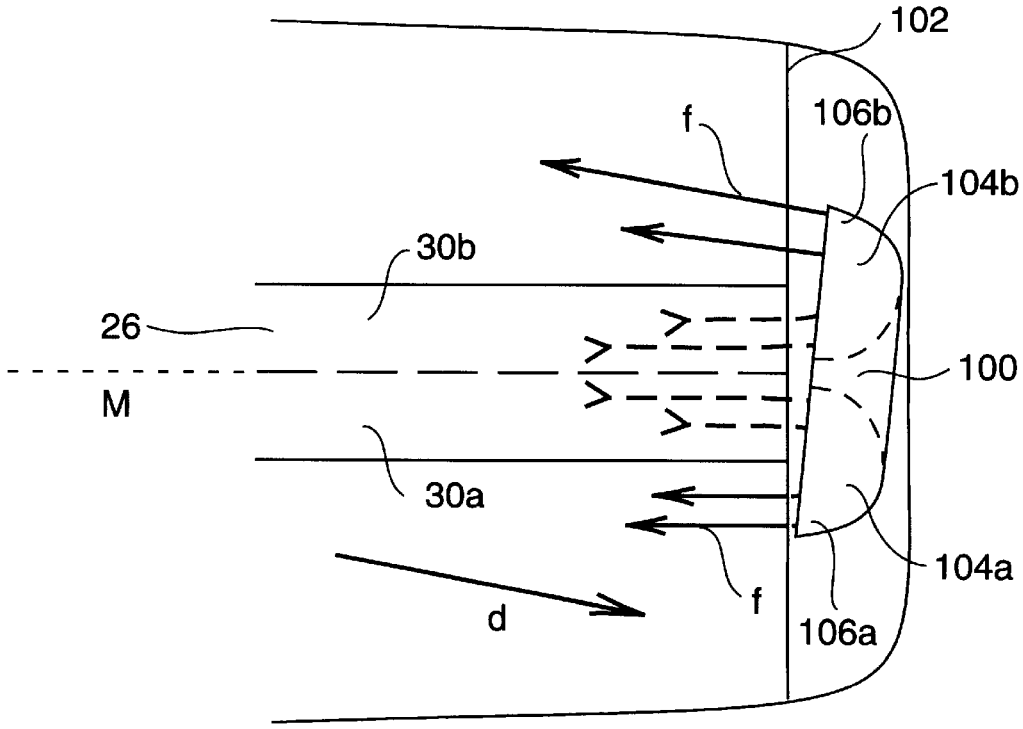
FIG. 14 is diagrammatic bottom plan view (similar to the view in FIG. 13) of the inventive embodiment shown operating in FIG. 12, particularly illustrating operation of the inventive backing system wherein the bucket is deployed for effecting maneuvering backing of the marine vessel.

With reference to FIG. 12 through FIG. 15, another inventive backing system utilizes one or more buckets 100 to reverse the water flow. The views shown in FIG. 13 and FIG. 14 are from below the marine vessel and looking up. As discussed previously herein, existing waterjet steering and maneuvering systems are employed in the air. In contrast, the present invention executes steering and backing maneuvering underwater.

As shown in FIG. 12, a large bucket 100 is lowered into the discharge stream to enable reverse maneuvering. A member such as arm 101 is used to selectively raise, lower and rotate (in a horizontal plane) bucket 100. Arm 100 is connected to a mechanical device (not shown) for imparting movement thereto. In the light of this disclosure, the ordinarily skilled artisan is capable of devising a mechanical scheme suitable for moving and positioning bucket 100 in accordance with the present invention.

Bucket 100 has a width $w_B$ which is greater than the total width $w_T$ of inventive flow exit assembly 26, thus completely covering flow exit chambers 30*a* and 30*b* at outlet (discharge) ends 50*a* and 50*b*, respectively. Bucket 100 has a height $h_B$ which is roughly equal to the height h of the inventive exit assembly 26 (or, in other words, the height h of each of chambers 30*a* and 30*b*).

In non-maneuvering (straight) backing operation, the concave inside of bucket 100 faces the water flow discharge so as to be approximately parallel to chamber outlet ends 50*a* and 50*b* and to the marine vessel's transom stern 102, as shown in FIG. 12 and FIG. 13. Water elevation line e (shown in FIG. 12 and FIG. 15) falls slightly above topwall 32 of inventive flow exit assembly 26. As indicated in FIG. 13 by navigational directional arrow d, the marine vessel is going approximately straight backward.

The inside of bucket 100 includes two adjacent approximately congruous scoop-like portions, scoop 104*a* and scoop 104*b*. Scoops 104*a* and 104*b* catch the discharged flow f from chamber outlet (discharge) ends 50*a* and 50*b*, respectively, and turn the discharged flow f around so that the discharged flow f exits bucket 100 along the outboard sides 106*a* and 106*b* of bucket 100, and in the reverse direction d. The change in momentum of the discharge jets imparts a reverse thrust on the marine vessel (e.g., ship).

Bucket 100 also enables maneuvering control while the marine vessel is going in reverse. Bucket 100 is rotatable in the horizontal plane, as shown in FIG. 14. Rotating bucket 100, or tilting bucket 100 to the side, chokes the flow on one side (chamber outlet end 50*a*, as shown in FIG. 14) and opens the flow on the other side (chamber outlet end 50*b*, as shown in FIG. 14). The greater discharge on one side of the marine vessel causes asymmetry in the discharge f, and reverse thrust becomes obliquely angled with respect to the marine vessel's axis M; that is, the greater reverse flow in association with scoop 104*b* produces a turning moment.

The angled reverse thrust causes the marine vessel to travel backward at a corresponding angle. In this manner, maneuvering control is provided while the marine vessel is reversing. As indicated in FIG. 14 by navigational directional arrow d, the marine vessel is going backward at an oblique angle with respect to the marine vessel's longitudinal axis M.

Figure 15:
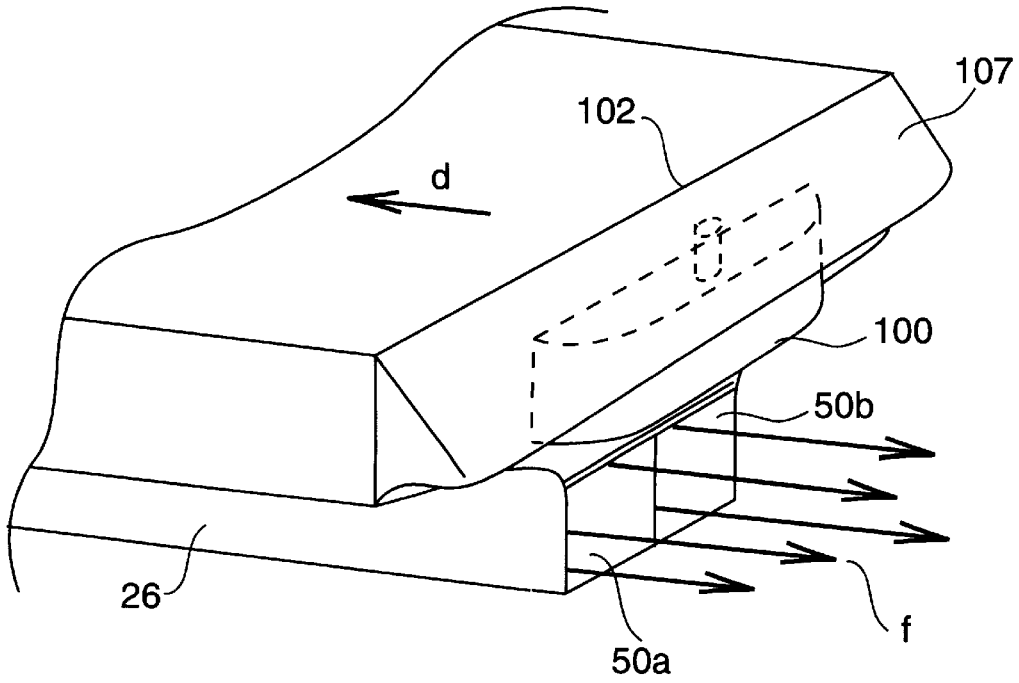
FIG. 15 is diagrammatic rear perspective view (similar to the view in FIG. 12) of the inventive embodiment shown operating in FIG. 12, particularly illustrating operation of the inventive backing system wherein the bucket is retracted deployed for effecting forward motion of the marine vessel.

As shown in FIG. 15, during forward motion of the marine vessel wherein backing is not required, bucket 100 is retracted (raised out of the water) into a shelter-like structure 107, which is attached to or integral with the transom stern 102 of the marine vessel. Thus disassociated via retraction, bucket 100 exerts no influence on the forward motion d of the marine vessel. Flow f which is discharged from flow exit chambers 30*a* and 30*b* is unimpeded, and hence accelerates in a generally backward direction.

Figure 16:
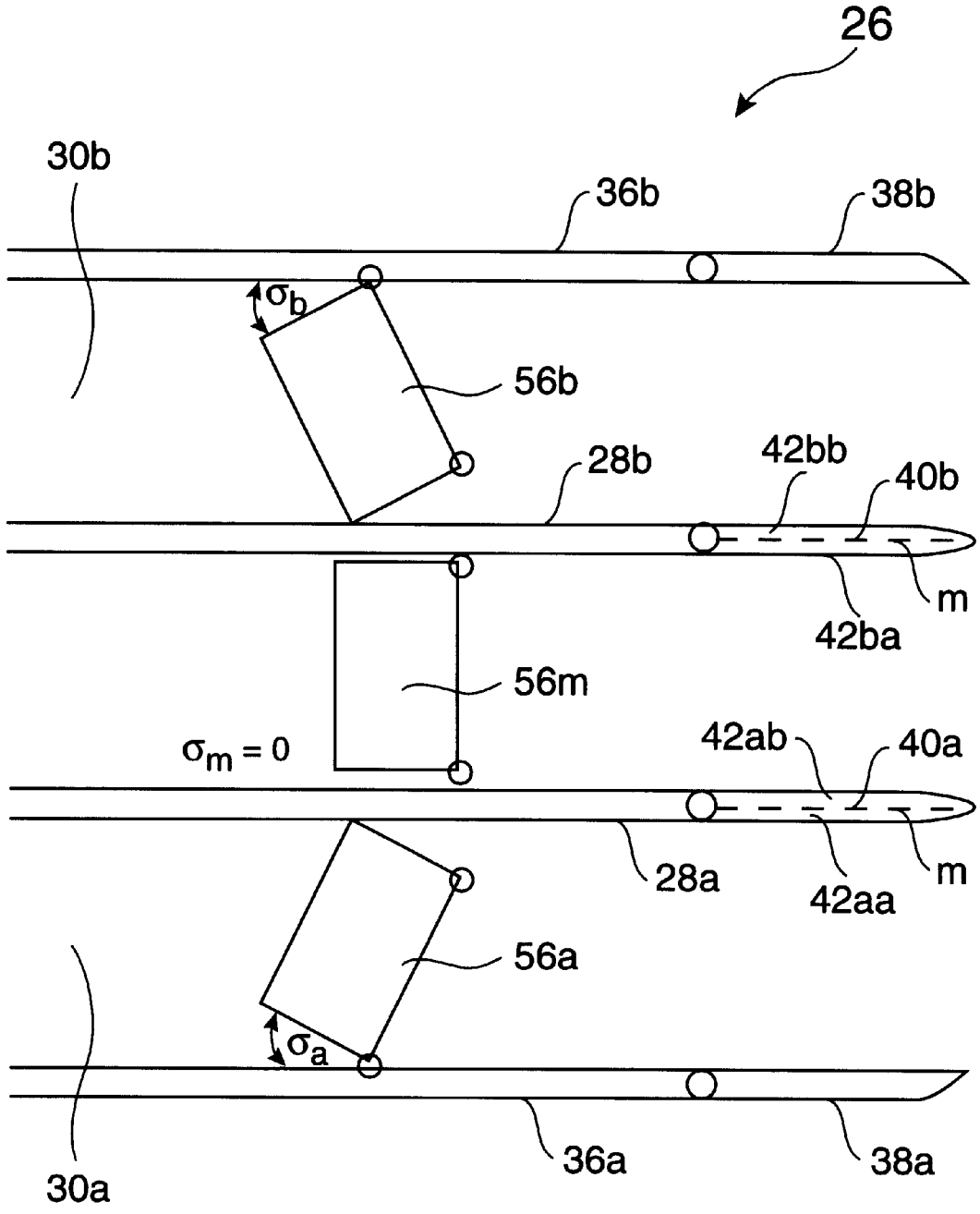
FIG. 16 is a diagrammatic top plan view, partially cutaway, of an inventive embodiment characterized by three flow-straightening exit chambers and four sidewalls (including four steering flaps corresponding therewith).

Now referring to FIG. 16, the principles of the present invention are applicable to any plural number of flow exit chambers 30. Here, inventive flow exit assembly 26 has three flow exit chambers (viz., 30*a*, 30*b* and 30*m*) and four sidewalls (viz., lateral sidewall 36*a*, lateral sidewall 36*b*, medial sidewall 28*a* and medial sidewall 28*b*). Lateral sidewall 36*a* includes lateral sidewall flap 38*a*. Lateral sidewall 36*b* includes lateral sidewall flap 38*b*. Medial sidewall 28*a* includes medial sidewall flap 40*a*. Medial sidewall 28*b* includes medial sidewall flap 40*b*. Medial sidewall flap 40*a* and medial sidewall 40*b* are each longitudinally splittable into a medial flap subsection; medial sidewall flap 40*a* includes medial sidewall flap subsections 42*aa* and 42*ab*, and medial sidewall flap 40*b* includes medial sidewall flap subsections 42*ba* and 42*bb*.

Accordingly, an inventive flow exit assembly 26 having any plural number of flow exit chambers 30 can be inventively practiced. In the light of the instant disclosure, the ordinarily skilled artisan will be capable of.practicing the present invention in relation to any plural number of flow exit chambers 30. Any number (singular or plural) of waterjet pumps 20 can be implemented in association with inventive flow exit assembly 26. It may be preferable for some inventive embodiments to utilize at least two waterjet pumps 20, wherein each waterjet pump is associated with at least one flow exit chamber 30; in the event of failure of a waterjet pump 20, at least one functional waterjet pump 20 remains.

Certain general principles obtain with regard to practice of the present invention, particularly as pertains to the number of flow exit chambers 30. Generally, an inventive flow exit assembly 26 characterized by "N" number of flow exit chambers 30 will also be characterized by the following: "N+1" number of total sidewalls, viz., medial sidewalls 28 plus lateral sidewalls 36; two lateral sidewalls 36; "N−1" number of medial sidewalls 28; and, "2(N−1)" number of medial sidewall flap subsections 42. In addition, oblique dispositional angles θ of bottomwall flaps 56 will be "balanced," similarly as exemplified in FIG. 16, wherein bottomwall flaps 56*a* and 56*b* are approximately equally and oppositely disposed at angles $\theta_a$ and $\theta_b$respectively, while bottomwall flap 56*m* is disposed at an angle $\theta_m$ which approximately equals zero.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. A waterjet exit assembly comprising an upper horizontal wall, a lower horizontal wall and a plurality of approximately equidistantly spaced vertical walls; said upper horizontal wall, said lower horizontal wall and said vertical walls forming a plurality of adjacent channels for said waterjet; said waterjet assembly comprising a plurality of horizontally pivotable vertical flaps wherein each said vertical wall includes a said vertical flap; each said vertical flap being capable of deflecting to selected dispositions with respect to its corresponding said vertical wall.

2. A waterjet exit assembly as in claim 1, where said plurality of verticals wall numbers one more than said plurality of adjacent channels, and wherein said plurality of vertical walls numbers said plurality of vertical flaps.

3. A waterjet exit assembly as in claim 1, wherein said vertical flaps are capable of said deflecting approximately in unison to approximately equivalent said selected dispositions.

4. A waterjet exit assembly as in claim 1, wherein:

said vertical walls include two lateral vertical walls and at least one medial vertical wall;

each of said at least one medial vertical wall includes a said vertical flap which is a divisible vertical flap, said divisible vertical flap being divisible into two horizontally pivotable demiflaps; and each said demiflap is capable of deflecting to selected dispositions with respect to its corresponding said medial vertical wall.

5. A waterjet exit assembly as in claim 4 wherein, for each said divisible vertical flap, two corresponding said demiflaps are capable of said deflecting approximately in unison to approximately equivalently opposite said selected dispositions.

6. A waterjet exit assembly as in claim 5 wherein, approximately in unison:

a first plurality of said demiflaps are capable of said deflecting to approximately equivalent first said selected dispositions;

a second plurality of said demiflaps are capable of said deflecting to approximately equivalent second said selected dispositions;

said first plurality and said second plurality are equal; and said first said selected dispositions and said second said selected dispositions are approximately equivalently opposite.

7. A waterjet exit assembly as in claim 6, wherein:

said two lateral vertical walls are a first lateral vertical wall and a second lateral vertical wall;

said first lateral vertical wall includes a said vertical flap which is a first lateral vertical flap;

said second lateral vertical wall includes a said vertical flap which is a second lateral vertical flap;

said first said selected dispositions are approximately equivalently opposite to said selected disposition for said first lateral vertical flap; and said second said selected dispositions are approximately equivalently opposite to said selected disposition for said second lateral vertical flap.

8. A waterjet exit assembly as in claim 7, wherein:

said first plurality includes a said demiflap which is a first lateralmost demiflap, said first lateralmost demiflap being adjacent said first lateral vertical flap;

said second plurality includes a said demiflap which is a second lateralmost demiflap, said second lateralmost demiflap being adjacent said second lateral vertical flap;

said first lateralmost demiflap is capable of meeting said first lateral vertical flap; and said second lateralmost demiflap is capable of meeting said second lateral vertical flap.

9. A waterjet exit assembly as in claim 8, wherein:

said vertical walls number at least four;

said channels number at least three;

said first plurality includes at least two said demiflaps which are first interior demiflaps;

said second plurality includes at least two said demiflaps which are second interior demiflaps;

each said first interior demiflap is associated with a said second interior demiflap which faces said first interior demiflap and which has a different corresponding said medial vertical wall; and each said first interior demiflap and its associated said second interior demiflap are capable of converging, meeting and diverging.

10. A waterjet exit assembly as in claim 1, wherein said lower horizontal wall includes a plurality of vertically pivotable horizontal flaps, each said horizontal flap correspond to a said channel, each said horizontal flap being capable of deflecting below said lower horizontal wall to selected dispositions with respect to said lower horizontal wall.

11. A waterjet exit assembly as in claim 1, wherein said vertical walls number three, wherein said channels number two, and wherein said flaps number three.

12. A waterjet exit assembly as in claim 11, wherein said three flaps are capable of said deflecting approximately in unison to approximately equivalent said selected dispositions.

13. A waterjet exit assembly as in claim 11, wherein:

said vertical walls include a medial vertical wall and two lateral vertical walls;

said medial vertical wall includes a said flap which is a divisible flap, said divisible flap being divisible into two horizontally pivotable demiflaps; and each said demiflap is capable of deflecting to selected dispositions with respect to said medial vertical wall.

14. A waterjet exit assembly as in claim 13, wherein said two demiflaps are capable of said deflecting approximately in unison to approximately equivalently opposite said selected dispositions.

15. A waterjet exit assembly as in claim 14, wherein:

said two demiflaps are a first demiflap and a second demiflap;

said two lateral vertical walls are a first lateral vertical wall and a second lateral vertical wall;

said first lateral vertical wall includes a said flap which is a first lateral flap;

said second lateral vertical wall includes a said flap which is a second lateral flap;

said first demiflap faces said first lateral vertical flap;

said second demiflap faces said second lateral vertical flap;

said first demiflap and said first lateral vertical flap are capable of said deflecting approximately in unison to approximately equivalently opposite said selected dispositions; and said second demiflap and said second lateral vertical flap are capable of said deflecting approximately in unison to approximately equivalently opposite said selected dispositions.

16. A waterjet exit assembly as in claim 15, wherein:

said first demiflap and said first lateral vertical flap are capable of converging, meeting and diverging; and said second demiflap and said second lateral vertical flap are capable of converging, meeting and diverging.

17. For use in association with waterjet means such as including pumping means, said waterjet means being capable of discharging accelerated water for propelling a marine vessel, apparatus for controlling the flow of said accelerated water for maneuvering said marine vessel; said apparatus approximately describing a rectangular parallelepiped periphery having two open ends; said apparatus comprising an upper wall, a lower wall, a first lateral side wall, a second lateral side wall and a medial side wall; said upper wall including a first upper wall portion and a second upper wall portion; said lower wall including a first lower wall portion and a second lower wall portion; said medial side wall being approximately intermediate said first lateral side wall and said second lateral side wall; said apparatus thereby defining for said flow a first chamber and a second chamber; said first chamber being bounded by said first lateral side wall, said medial side wall, said first upper wall portion and said first lower wall portion; said second chamber being bounded by said second lateral side wall, said medial side wall, said second upper wall portion and said second lower wall portion; said first lateral side wall including a first lateral side flap; said second lateral side wall including a second lateral side flap; said medial side wall including a medial side flap; said first lateral side flap being bidirectionally rotatable on either side of and through an approximately flush approximately zero angle position with respect to said first lateral side wall; said first lateral side flap thereby being positionable at selected angles with respect to said first lateral side wall; said second lateral side flap being bidirectionally rotatable to either side of and through an approximately flush approximately zero angle position with respect to said second lateral side wall; said second lateral side flap thereby being positionable at selected angles with respect to said second lateral side wall; said medial side flap being bidirectionally rotatable on either side of and through an approximately flush approximately zero angle position with respect to said medial side wall; said medial side flap thereby being positionable at selected angles with respect to said medial side wall.

18. Apparatus for controlling the flow as in claim 17, wherein said first lateral side flap, said second lateral side flap and said medial side flap are each independently rotatable.

19. Apparatus for controlling the flow as in claim 17, wherein said first lateral side flap, said second lateral side flap and said medial side flap are approximately sychronously rotatable for positioning at said selected angles.

20. Apparatus for controlling the flow as in claim 17, wherein said first lateral side flap, said second lateral side flap and said medial side flap are approximately synchronously rotatable approximately in parallel for positioning at approximately equal said selected angles.

21. Apparatus for controlling the flow as in claim 20, wherein said apparatus thereby steers said marine vessel.

22. Apparatus for controlling the flow as in claim 20, wherein said first lateral side flap, said second lateral side flap and said medial side flap are each rotatable up to at least thirty degrees on either side of its corresponding side wall.

23. Apparatus for controlling the flow as in claim 17, wherein said medial side flap is splittable into a pair of medial semiflaps, each said medial semiflap being bidirectionally rotatable on one side of and to an approximately flush approximately zero angle position with respect to said medial side wall.

24. Apparatus for controlling the flow as in claim 23, wherein said first lateral side flap, said second lateral side flap, said medial side flap and said medial semiflaps are each independently rotatable.

25. Apparatus for controlling the flow as in claim 23, wherein each said medial semiflap is rotatable up to at least thirty degrees with respect to said medial side wall.

26. Apparatus for controlling the flow as in claim 25, wherein said medial semiflaps are approximately synchronously rotatable approximately equally oppositely for positioning at approximately equally opposite said selected angles.

27. Apparatus for controlling the flow as in claim 26, wherein each said medial semiflap and a said lateral side flap are approximately synchronously rotatable approximately equally oppositely for positioning at approximately equally opposite said selected angles.

28. Apparatus for controlling the flow as in claim 27, wherein each said medial semiflap and a said lateral side flap are rotatable for positioning conjunctively.

29. Apparatus for controlling the flow as in claim 28, wherein:

said first lower wall portion includes a first lower flap;

said second lower wall portion includes a second lower flap;

said first lower flap is bidirectionally rotatable, with respect to said first lower wall portion, between an approximately flush approximately zero angle position and an angle below said first lower wall portion of at least thirty degrees; and said second lower flap is bidirectionally rotatable, with respect to said second lower wall portion, between an approximately flush approximately zero angle position and an angle below said second lower wall portion of at least thirty degrees.

30. Waterjet marine propulsion apparatus, comprising:

means for ejecting accelerated water; and a water outlet device for directing said accelerated water;

wherein said water outlet device includes:

a top approximately planar horizontal structure;

a bottom approximately planar horizontal structure; and at least three approximately planar vertical structures;

wherein said water outlet device has a fore device end and an aft device end;

wherein said water outlet device engages said means for ejecting at said fore device end;

wherein said accelerated water enters said water outlet device at said fore device end, and exits said water outlet device at said aft device end;

wherein said horizontal structures and said vertical structures are configured to define at least two channels;

wherein each said channel describes the approximate shape of a rectangular parallelipiped;

wherein each said vertical structure has a fore vertical structure end and an aft vertical structure end;

wherein each said vertical structure includes a vertical flap section at said aft vertical structure end;

wherein each said vertical flap section is horizontally pivotable toward either side of said vertical structure which includes said vertical flap;

wherein at least one said vertical flap section includes two vertical flap subsections; and wherein each said vertical flap subsection is horizontally pivotable toward a side of said vertical flap section which includes said vertical flap subsection.

31. Waterjet marine propulsion apparatus as in claim 30, wherein the number of said channels is one less than the number of said vertical structures.

32. Waterjet marine propulsion apparatus as in claim 30, wherein:

said bottom horizontal structure includes a plurality of horizontal flap portions;

each said horizontal flap portion is associated with one said channel;

each said horizontal flap portion is vertically pivotable in a direction which generally is downward and afterward;

said vertical flap sections and said vertical flap subsections are each horizontally pivotable whereby closure is effectuated at said aft device end;

when said closure is effectuated, said vertical flap sections and said vertical flap subsections are capable of deflecting said pressurized water in a direction which is generally opposite that of said accelerated water which enters said water outlet device at said fore device end; and when said closure is effectuated, said horizontal flap sections are capable of pivoting so as to release said accelerated water nearly in said direction which is generally opposite that of said accelerated water which enters said water outlet device at said fore device end.

33. Waterjet marine propulsion apparatus as in claim 30, wherein said waterjet marine propulsion apparatus comprises a bucket device which is positionable proximate said aft device end, and wherein said bucket device when thus positioned is capable of deflecting said accelerated water in a direction which is generally opposite that of said accelerated water which enters said water outlet device at said fore device end.

34. Waterjet marine propulsion apparatus as in claim 33, wherein said bucket device includes at least two scoop-shaped portions, and wherein each said scoop-shaped portion is associated with a said channel.

35. Waterjet marine propulsion apparatus as in claim 30, wherein said pumping means includes at least two pumps, and wherein at least two said channels are each associated with a different said pump.

* * * * *